US007383647B2

(12) United States Patent
Chan et al.

(10) Patent No.: US 7,383,647 B2
(45) Date of Patent: Jun. 10, 2008

(54) MECHANICAL CUSHIONING SYSTEM FOR FOOTWEAR

(75) Inventors: Marya L. Chan, Boston, MA (US); Patrick Y. Choe, Cambridge, MA (US); David J. Dirsa, Beaverton, OR (US); Edith Harmon-Weiss, Swampscott, MA (US); Sean B. Murphy, North Andover, NJ (US)

(73) Assignee: New Balance Athletic Shoe, Inc, Lawrence, MA (US)

( * ) Notice: Subject to any disclaimer, the term of this patent is extended or adjusted under 35 U.S.C. 154(b) by 86 days.

(21) Appl. No.: 11/077,327

(22) Filed: Mar. 10, 2005

(65) Prior Publication Data

US 2006/0201028 A1 Sep. 14, 2006

(51) Int. Cl.
*A43B 13/18* (2006.01)

(52) U.S. Cl. ..... 36/28; 36/27

(58) Field of Classification Search ..... 36/28, 36/27, 30 R, 25 R
See application file for complete search history.

(56) References Cited

U.S. PATENT DOCUMENTS

| | | | | |
|---|---|---|---|---|
| 4,536,974 | A | 8/1985 | Cohen | |
| 4,611,412 | A | 9/1986 | Cohen | |
| 4,638,577 | A | 1/1987 | Riggs | |
| 4,753,021 | A | 6/1988 | Cohen | |
| 4,754,559 | A | 7/1988 | Cohen | |
| 5,224,277 | A | 7/1993 | Sang Do | |
| 5,279,051 | A * | 1/1994 | Whatley | 36/25 R |
| 5,337,492 | A | 8/1994 | Anderie et al. | |
| 5,461,800 | A | 10/1995 | Luthi et al. | |
| 5,625,964 | A | 5/1997 | Lyden et al. | |
| 5,713,140 | A | 2/1998 | Baggenstoss | |
| 5,784,808 | A | 7/1998 | Hockerson | |
| 5,822,886 | A | 10/1998 | Luthi et al. | |
| 5,839,208 | A | 11/1998 | Huang | |
| 6,115,943 | A | 9/2000 | Gyr | |
| 6,769,202 | B1 | 8/2004 | Luthi et al. | |
| 2002/0050077 | A1 | 5/2002 | Wang et al. | |
| 2006/0042120 | A1 * | 3/2006 | Sokolowski et al. | 36/29 |

OTHER PUBLICATIONS http://reviews.ebay.com/A-Comparison-Between-Nike-Air-Nike-Shox-and-Nike-Impax_W0QQugidZ10000000004244893, p. 6-7, Ebay Guides, United States, copy provided as filed on Oct. 25, 2007.

* cited by examiner

*Primary Examiner*—Ted Kavanaugh
(74) *Attorney, Agent, or Firm*—Goodwin Procter LLP

(57) ABSTRACT

A midsole for footwear comprising a midsole element, which comprises a top plate, a bottom plate, and a plurality of strut members disposed between the top and bottom plates for supporting the top plate a distance away from the bottom plate. Adjacent strut members have a C shaped cross-section facing in the same direction. The midsole element may further comprise a heel cleft to increase the flexibility of the sole. In a preferred embodiment, the strut members on the medial side are arranged at an angle to the strut members on the lateral side of the sole. The directional design provides flexibility and stiffness anisotropically to the sole in the longitudinal and lateral directions of the sole respectively.

48 Claims, 19 Drawing Sheets

MECHANICAL CUSHIONING SYSTEM FOR FOOTWEAR

BACKGROUND OF THE INVENTION

Footwear, in particular athletic footwear, are expected to provide proper shock absorption and stability thereby preventing potential harmful effects of vigorous movements such as running and jumping on the wear's feet. The footwear industry has been developing athletic shoes in an effort to maximize shock absorption and stability while also maximizing comfort and durability. Unfortunately, these goals are potentially in conflict with each other. For example, a shoe that provides adequate shock absorption and comfort may not provide sufficient stability. To further advance the development of athletic shoes, a basic understanding of the dynamics of running and the mechanisms of running injuries is important.

A typical walking or running gait cycle involves two phases: (1) a stance phase, and (2) a swing phase. One foot contacts the support surface such as the ground and bears weight in the stance phase while the other foot is moving through the air and advances in the swing phase. The two phases are repetitive. The difference between the running and walking gait cycles is that at one point during the running cycle the person is airborne without bearing any weight, whereas the walking cycle does not have such an airborne point.

The stance phase of a running gait cycle may be further divided into three periods: (1) the loading period, also called the impact and support period or the heel strike period, (2) the mid-stance period, also called the mid-stance and propulsion period, and (3) the toe-off period, also called the recovery period. For a typical runner of a heel-to-toe running style, the loading period begins with first contact of the heel with the running surface, followed by a controlled lowering of the forefoot to the running surface. The first contact of the heel typically occurs at the rear, outer part of the heel. The mid-stance period begins once the forefoot is in contact with the running surface. During the mid-stance period, the contraction of the musculature of the leg generates power to propel the body forward. The heel progressively lifts and the forefoot flexes at the metatarsophalangeal joint. Then in the toe-off period, the foot disengages contact with the running surface and the foot becomes airborne.

Pronation is a normal movement of the foot that occurs during the loading and mid-stance periods of the stance phase of the gait cycle. At heel strike during the loading period, the heel of the foot is supinated and makes initial contact with the running surface as described earlier. Instantaneously, the joint between the foot bones called the subtalar joint is unlocked, allowing pronation, a coordinated triplane motion of the foot, to occur during the forefoot lowering events of the loading period of the stance phase. The coordinated triplane motion of the foot involves three planes of motion: (1) abduction, in which the front of the foot is turned outwards and away from the line of progression of the runner; (2) dorsiflexion, in which the front of the foot is angled upwards relative to the heel of the foot; and (3) eversion, in which the sole of the foot is turned outward relative to the heel of the foot. With the combination of these three motions, the foot rolls from the outside or lateral side to the inside or medial side of the foot resulting in the medial aspect (the arch area) of the foot coming into contact with the running surface, thus allowing the foot to adapt to the running surface and to transfer some of the loading force to the running surface, thereby reducing the risk of injury during the stance phase of running. The pronated position of the foot is maintained throughout the mid-stance period.

Supination typically follows pronation. As the body moves forward over the foot, the subtalar joint locks. This allows a reversal of the events that have occurred during the loading period to occur during the mid-stance period. Supination is a coordinated triplane motion of the foot, which involves three planes of motion: (1) adduction, in which the locking of the subtalar joint allows the foot to turn inward toward the line of progression; (2) plantarflex, in which the forefoot is flexed downward relative to the heel; and (3) inversion, in which the sole of the foot is turned inward relative to the heel. With the combination of these three motions, the foot continues rolling forward onto the toes. During motion through ball and toe contact, the foot rolls outward just before the toes starts to leave the ground. The combination of these motions allows the foot to be converted from a mobile adaptor to a rigid lever, which is essential for the forward propulsion of the body. The foot remains supinated while it is off the ground between steps.

Although pronation is a natural action and is considered an important and healthy response to the intense amount of shock imposed upon the foot, excessive pronation and high pronation velocity have been suggested by biomechanists to cause a variety of injuries at the ankle, knee and hip among runners and other athletes. Many prior art soles have been designed to control pronation and supination. However, as the stability of the sole increases to control the amount of lateral motion of a foot in order to prevent excessive pronation, the shock absorption properties for reducing the impact of strike forces on the foot usually decrease. Thus, the footwear industry continues to seek a proper balance between the stability and shock absorption properties in designing shoe soles.

For Example, U.S. Pat. No. 5,625,964, issued to Lyden et al., discloses an athletic shoe having a sole with a rearfoot strike zone segmented from the remaining heel area by a line of flexion which permits articulation of the strike zone during initial heel strike of a runner. The line of flexion is located to delimit a rearfoot strike zone reflecting the heel to toe running style of the majority of the running population. In addition to allowing articulation of the rearfoot strike zone about the line of flexion, the sole incorporates cushioning elements, including a resilient gas filled bladder, to provide differential cushioning characteristics in different parts of the heel, to attenuate force applications and shock associated with heel strike, without degrading footwear stability during subsequent phases of the running cycle. The line of flexion may be formed by various ways including a deep groove, a line of relatively flexible midsole material, and a relatively flexible portion of a segmented fluid bladder.

The athletic shoes presently available on the market are typically of a multiple layer construction comprised of an outsole, a midsole and an insole. The outsole is normally formed of an abrasion-resistant material such as rubber and is the portion of the sole that contacts the ground. The midsole is the portion between the outsole and the insole and is typically comprised of a compressible material such as ethylene vinyl acetate (EVA) foam for cushioning. The insole is the portion in contact with the wearer's foot and is normally comprised of a soft pad to enhance shoe comfort.

Durability of the midsole is also an important goal for sole design. Foam materials such as the EVA foam commonly used in the midsole have limited useful lives and tend to break down over time. Alternative midsole designs that are not or less dependent on the foam materials have been developed over the past years.

For example, U.S. Pat. Nos. 4,536,974, 4,611,412, 4,754,559 and 4,573,021, all issued to Eli Cohen, describe midsoles provided with a plurality of pairs of ribs. All of the ribs are provided with at least one bowed or convex surface running the length of the rib. When weight is placed upon the sole, each of the ribs initially begins to deflect until adjacent ribs abut one another at which point the ribs begin to compress. Inserts may be placed between adjacent rib pairs to fill the space between the adjacent rib pairs to inhibit the deflection of the ribs. Compressible bridging elements may be provided between the pairs of ribs to avoid the noises resulted from the constant contact and releasing of the ribs of adjacent pairs.

U.S. Pat. Nos. 5,461,800 and 5,822,886, both issued to Simon Luthi et al., describe integrally molded midsoles having tubular suspension members. The tubular suspension members behave as springs and have spring constants which may be designed for a particular application by choice of the tube length, the tube wall thickness or the hardness of the tube material. Preferably, the midsole is made of an elastomer such as HYTREL® that is cast in a preformed shape and thereafter subjected to substantial compressive forces so that the tubular springs take a compression set and thereafter perform as near-ideal springs.

U.S. Pat. No. 5,337,492, issued to Wolf Anderié et al., describes a shoe bottom having a plurality of individual flexurally resilient carrier elements which are directed transversely with respect to the longitudinal direction of the shoe and which are arranged at spacings one behind the other in the longitudinal direction of the shoe. The carrier elements are connected to a cover plate portion on the foot side and to an outsole layer on the outward side. Each carrier element is formed by a closed box profile with an upper web portion which extends transversely with respect to the longitudinal direction of the shoe, a lower web portion which is parallel to the upper web portion, two lateral support walls which connect the ends of the web portions together and bracing means supporting the upper web portion relative to the lower web portion.

U.S. Pat. No. 6,769,202, issued to Simon Luthi et al., describes a sole unit for a shoe including a directional element, a cushioning element and, optionally a heel cradle. The directional element has a top plate, a bottom plate and multiple generally parallel strut elements oriented transversely to the longitudinal axis of the directional element and connected to the top plate and the bottom plate. The cushioning element is adapted to be received in the directional element, more specifically between the strut members of the directional element.

The prior art soles described above do not provide the shoes with optimal shock absorption and stability due to their design. The present invention seeks to provide a midsole for a shoe which provides superior shock absorption and stability properties and which can be customized for different applications and individuals.

SUMMARY OF THE INVENTION

In view of the foregoing, it is an object of the present invention to provide an athletic shoe that optimizes the conflicting concerns of shock absorption and stability, while also maximizing comfort and durability.

It is a more specific object of the present invention to construct an athletic shoe having a sole unit which provides differential cushioning properties at different regions of the sole, so as to attenuate impact forces at heel strike without introducing instability to the subsequent motion in the running gait cycle.

It is another object of the present invention to provide an athletic shoe sole that adopts a mechanical cushioning system, which is designed to absorb impact forces with a specific configuration of an elastic and durable material, eliminating the need for relying heavily on the less durable foam material for impact absorption.

It is a further object of the present invention to provide an athletic shoe sole having a mechanical cushioning system which can be easily customized for the specific application and individual wearing the shoe by slightly modifying its configuration.

These and other objects are achieved by the midsole for an article of footwear in accordance with the present invention. Such midsole comprises a midsole element comprising: (a) a medial element comprising a top medial plate, a bottom medial plate, and a plurality of medial strut members disposed between the top and bottom medial plates for supporting the top medial plate a distance away from the bottom medial plate; and (b) a lateral element comprising a top lateral plate, a bottom lateral plate, and a plurality of lateral strut members disposed between the top and bottom lateral plates for supporting the top lateral plate a distance away from the bottom lateral plate; wherein at least a portion of the plurality of lateral strut members are arranged at an angle to at least a portion of the plurality of medial strut members. The angle between the lateral strut members and the medial strut members is greater than 0 degrees to less than 180 degrees, preferably about 5 to 120 degrees, more preferably about 10 to about 90 degrees, and most preferably about 15 to about 75 degrees.

In accordance with a further aspect of the present invention, the medial and lateral strut members in the midsole element described above have a C shaped cross-section when intersected by an imaginary plane that intersects the respective top and bottom medial and lateral plates at approximate right angles. Preferably at least two adjacent C shaped strut members face in the same direction.

In accordance with another aspect of the present invention, there is provided a midsole for an article of footwear comprising a midsole element, which comprises a top plate; a bottom plate; and a plurality of strut members disposed between the top and bottom plates for supporting the top plate a distance away from the bottom plate; at least two of the strut members being adjacent to each other and having a C shaped cross-section facing in the same direction when intersected by an imaginary plane that intersects the top and bottom plates at approximate right angles.

In accordance with a further aspect of the present invention, the midsole element described above further comprises a heel cleft which is medial to the point of heel strike at the midsole element. The heel cleft provides flexibility to the midsole and allows the midsole to bend at impact thereby decreasing the amount and velocity of pronation. The heel cleft is about 0 to about 180 degrees, preferably about 0 to about 120 degrees, more preferably about 0 to about 90 degrees, offset from the transverse axis of the midsole. For shoes intended for linear movement activities such as walking and running, the heel cleft is preferably about 15 to about 75 degrees, and more preferably about 17 and about 65 degrees, offset from the transverse axis of the midsole. For shoes intended for lateral movement activities such as basketball, the heel cleft may be about 65 to about 90 degrees, preferably about 75 to about 90 degrees, offset from the transverse axis of the midsole.

In accordance with a still further aspect of the present invention, there is provided an article of footwear which comprises an upper, a midsole of the present invention as described above, and an outsole.

DETAILED DESCRIPTION OF THE INVENTION

The present invention can be better understood from the following description of preferred embodiments, taken in conjunction with the accompanying drawings. It should be apparent to those skilled in the art that the described embodiments of the present invention provided herein are merely exemplary and illustrative and not limiting. All features disclosed in the description may be replaced by alternative features serving the same or similar purpose, unless expressly stated otherwise. Therefore, numerous other embodiments of the modifications thereof are contemplated as falling within the scope of the present invention and equivalents thereto.

Figure 1:
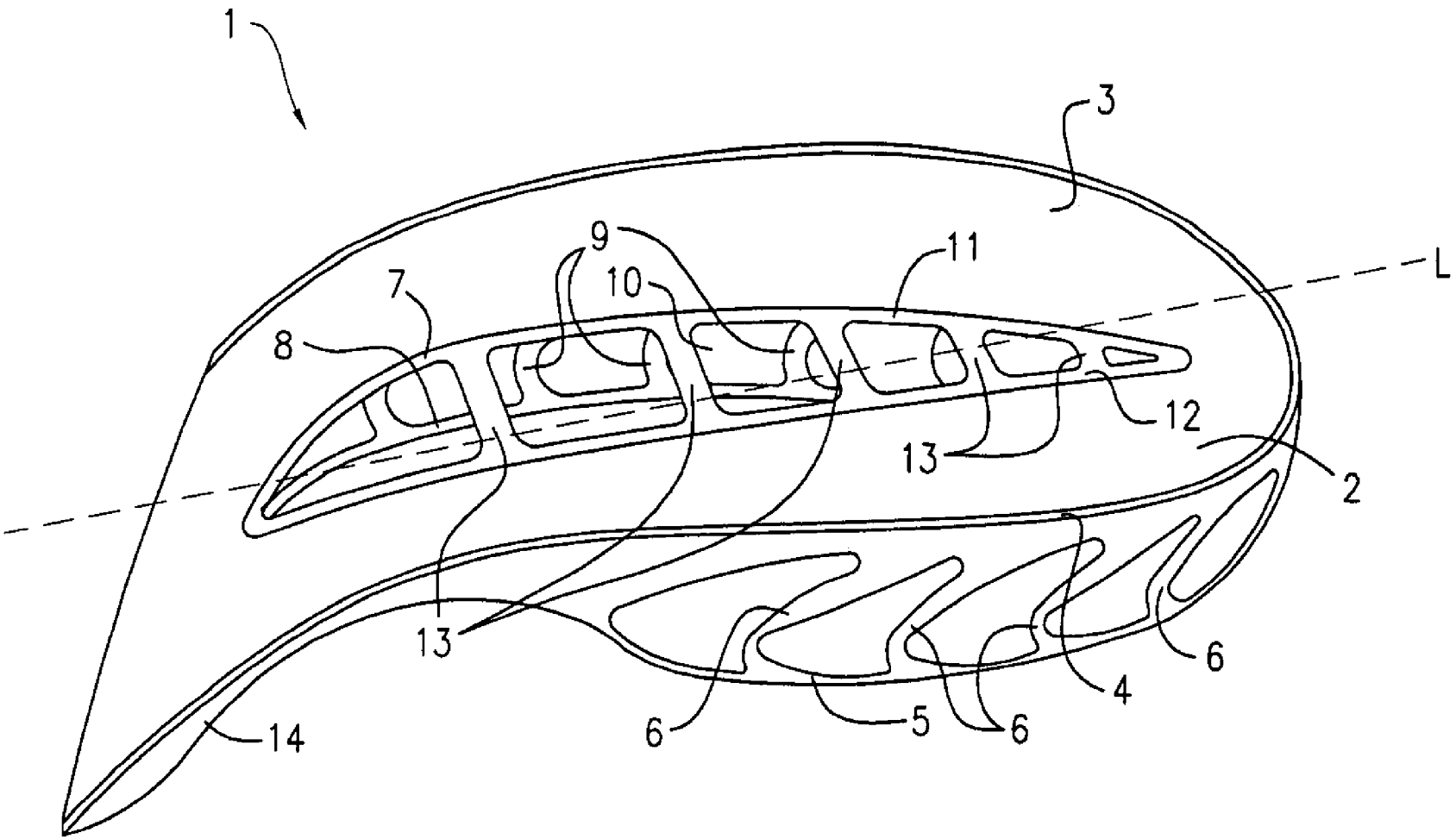
FIG. 1 is a perspective view of a midsole element according to the present invention.
Figure 2:
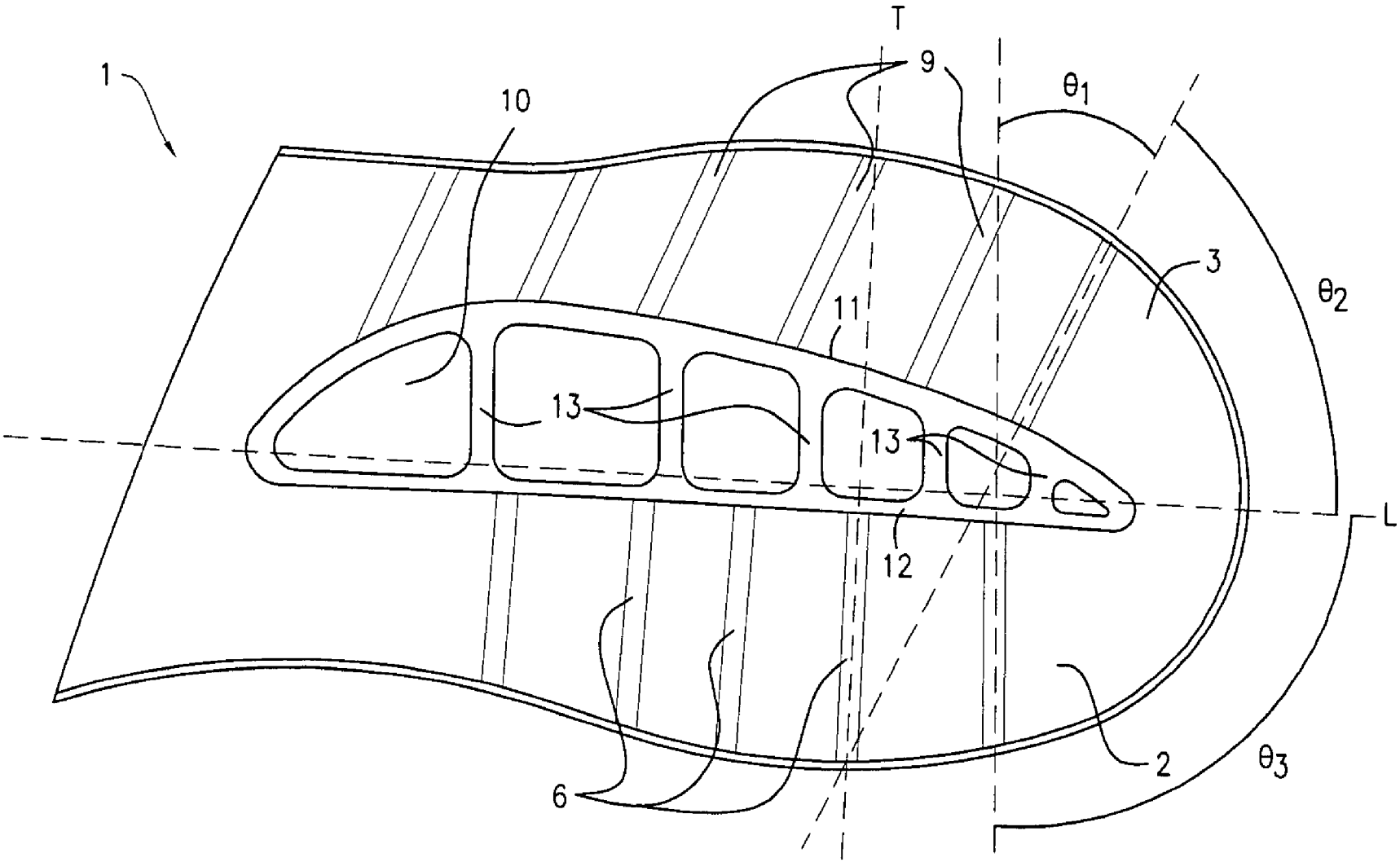
FIG. 2. is a cross-sectional view through, the midsole element of FIG. 1.

FIGS. 1 and 2 illustrate an exemplary embodiment of a midsole element in accordance with one aspect of the present invention. The midsole element 1 comprises: a medial element 2 and a lateral element 3. The medial element comprises a top medial plate 4, a bottom medial plate 5, and a plurality of medial strut members 6 disposed between the top and bottom medial plates 4, 5 for supporting the top medial plate 4 a distance away from the bottom medial plate 5. The lateral element 3 comprises a top lateral plate 7, a bottom lateral plate 8, and a plurality of lateral strut members 9 disposed between the top and bottom lateral plates 7, 8 for supporting the top lateral plate 7 a distance away from the bottom lateral plate 8; wherein at least a portion of the plurality of lateral strut members 9 are arranged at an angle ($\theta_1$) to at least a portion of the plurality of medial strut members 6. The angle $\theta_1$ is greater than 0 degrees to less than 180 degrees, preferably about 5 to about 120 degrees, more preferably about 10 to 90 degrees, and most preferably 15 to about 75 degrees. The directional design provides flexibility and stiffness anisotropically to the sole in the longitudinal and lateral directions of the shoe respectively.

The lateral strut members 9 are oriented at an angle ($\theta_2$) offset from the longitudinal axis L of the midsole element or the shoe receiving the midsole element. The lateral strut members may be oriented at an angle $\theta_2$ of greater than 0 degrees to less than 180 degrees, preferably greater than 0 degrees to about 90 degrees, more preferably about 10 to about 90 degrees, even more preferably about 15 to about 75 degrees, most preferably about 17 to about 65 degrees, offset from the longitudinal axis.

Figure 3:
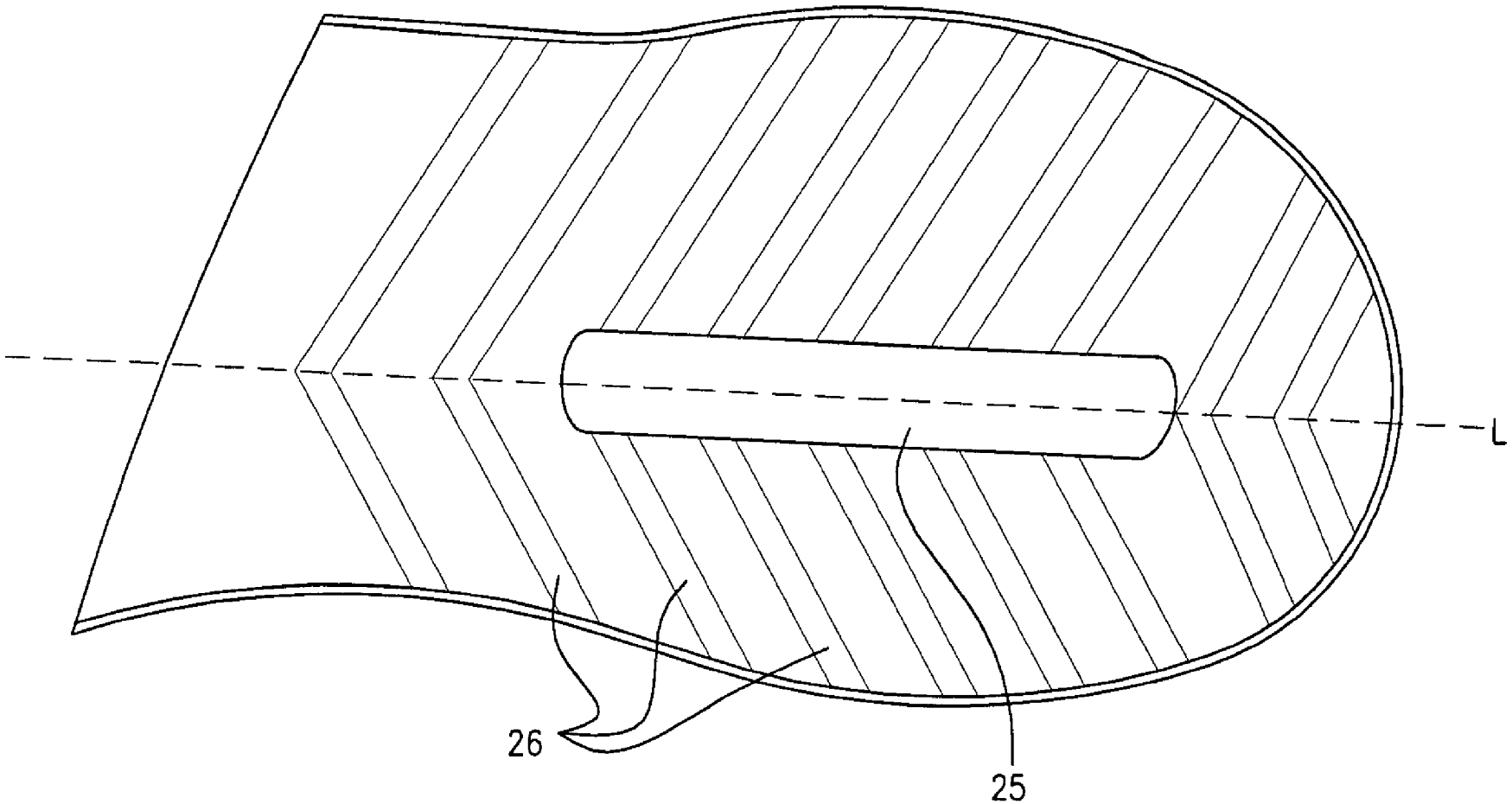
FIG. 3 illustrates an alternative embodiment of the present invention.

The medial strut members 6 are also oriented at an angle ($\theta_3$) offset from the longitudinal axis L. The medial strut members may be oriented at an angle $\theta_3$ of greater than 0 degrees to less than 180 degrees, preferably greater than 0 degrees to about 90 degrees, more preferably about 10 to about 90 degrees, for example, about 15 to about 75 degrees, offset from the longitudinal axis. The medial strut members 6 may be substantially perpendicular to the longitudinal axis L of the midsole to maximize lateral stability for shoes intended for linear movement activities such as walking and running as shown in FIG. 2. For shoes intended for lateral movement activities such as basketball, the medial strut members 26 may be arranged less than 90 degrees offset from the longitudinal axis L of the midsole as shown in FIG. 3.

In the embodiment of the present invention shown in FIGS. 1 and 2, the midsole element 1 has a cavity 10 between the medial element 2 and the lateral element 3. The cavity 10 has a lateral edge 11 and a medial edge 12. The lateral strut members 9 are perpendicular to the lateral edge 11 of the cavity and a portion of the medial strut members 6 are perpendicular to the medial edge 12 of the cavity. The cavity decouples the medial element 2 and the lateral element 3 and makes the midsole element 1 flexible. A flexible midsole allows the shoe to bend at impact thus decreasing the moment arm (lever) of the impact force applied to the shoe. Decreasing the moment arm decreases the torque around the subtalar joint thus decreasing the amount of pronation exhibited at the subtalar joint and decreasing the velocity of pronation, thereby increasing the stability of the shoe provided by the medial element 2, while maintaining an optimal shock absorption exhibited by the lateral element 3 of the midsole element 1.

Figure 4:
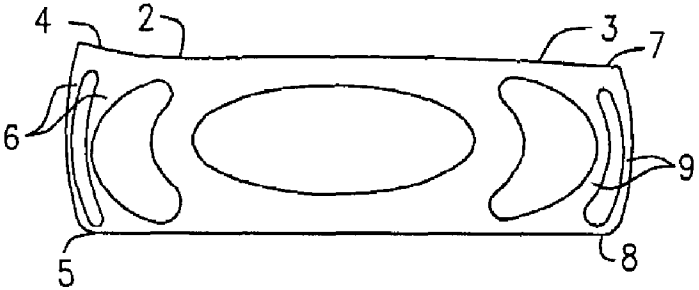
FIG. 4 is a rear view of the midsole element shown in FIG. 1.

The medial and lateral elements 2, 3 may be connected. For example, the medial and lateral elements 2, 3 may be connected at their rear ends as shown in FIG. 4 by integral molding. The medial and lateral elements may be further connected by at least one bridging member 13 between the top medial plate 4 and the top lateral plate 7. It is also contemplated that the one or more bridging members 13 may exist between the bottom medial plate 5 and the bottom lateral plate 8.

Figure 5:
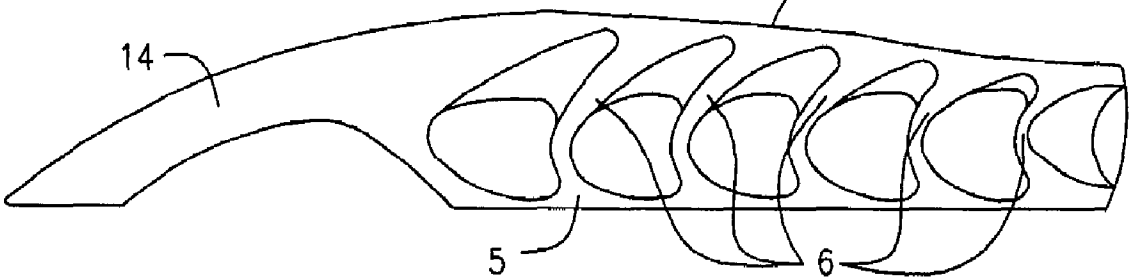
FIG. 5 is a medial side view of the midsole element shown in FIG. 1.

FIG. 5 is a medial side view of the midsole element 1. The medial strut members 6 disposed between the top medial plate 4 and the bottom medial plate 5 have a C shaped cross-section when intersected by an imaginary plane that intersects the top and bottom medial plates 4, 5 at approximate right angles. In this exemplary embodiment, all of the adjacent C shaped strut members face in the same direction. The strut members are spaced apart leaving open spacings between two adjacent strut members. Other embodiments having at least two adjacent C shaped strut members that face in the same direction are also contemplated as falling within the scope of the present invention. For example, the C shaped strut members in the heel region may face in the same direction whereas the C shaped strut members in the forefoot region may face in the opposite direction.

The C-shaped strut members are superior in cushioning properties than struts of other shapes such as S-shaped struts, wavy struts, straight struts and slanted struts. Although not wishing to be bound to any particular theory, C-shaped and S-shaped structures have different force versus deflection curve characteristics because an S-shaped structure has an inflection point in the center thereof whereas a C-shaped structure does not have an inflection point. This results in properties of an S-shaped structure, such as dynamic range and predictability, which are markedly different from that of a C-shaped strut member. For example, a C-shaped structure has a greater dynamic range than an S-shaped structure because the force-deflection curve for the C-shaped structure is more linear than the S-shaped structure. The force deflection curve for an S shaped strut illustrates compliance during the initial phases of deflection and stiffness in the later phases. In addition, an S-shaped structure is less predictable in performance than a C-shaped structure because the S-shaped structure has three regions of flexure whereas the C-shaped structure only has one region of flexure. Hence, uniformity of material is more important in an S-shaped strut member than in a C-shaped strut member. Wavy struts have even more regions of flexure than the S-shaped structure and therefore, have at least all of the disadvantages of the S-shaped structure discussed above. Straight and slanted struts do not offer controlled deformation and therefore, their response to impact force is hardly predictable. For example, depending on where the force is applied, the strut may bend in the top, middle or bottom of the strut.

Figure 6:
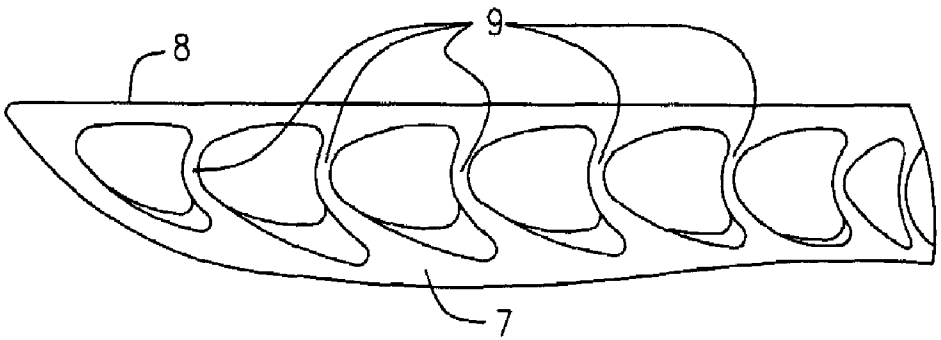
FIG. 6 is a lateral side view of the midsole element shown in FIG. 1 in an up-side-down position.
Figure 7:
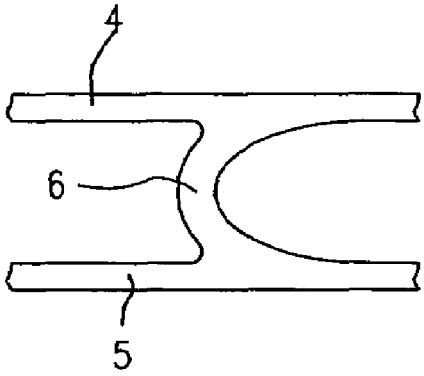
FIG. 7 is a side view of a section of the midsole element including a combination of a top plate, a bottom plate and a strut member.
Figure 8:
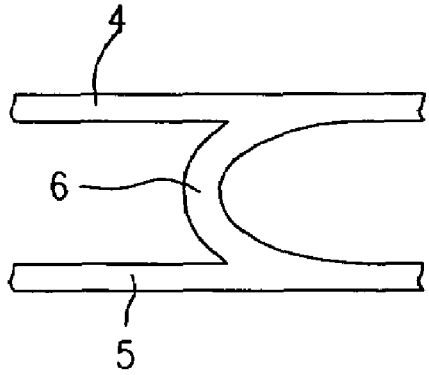
FIGS. 8-13 are various alternative embodiments of the present invention.
Figure 9:
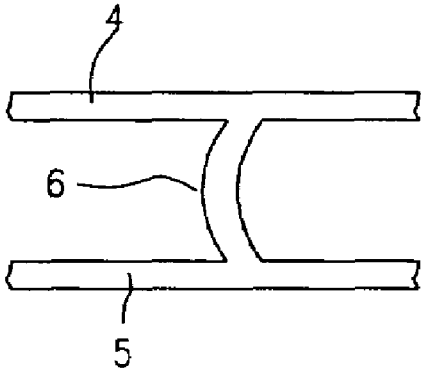
Figure 10:
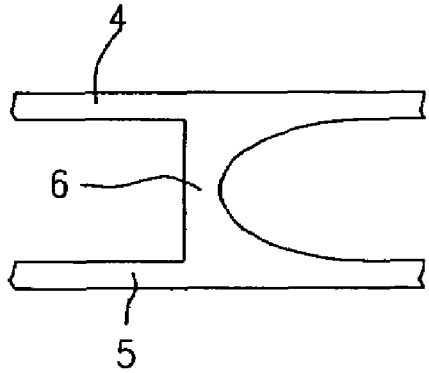
Figure 11:
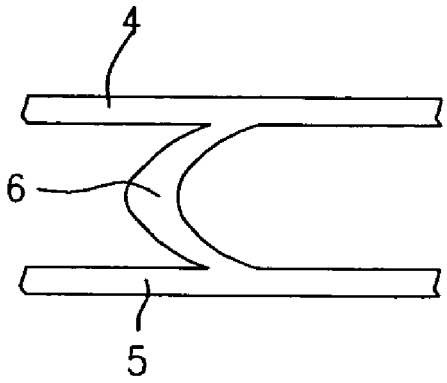
Figure 12:
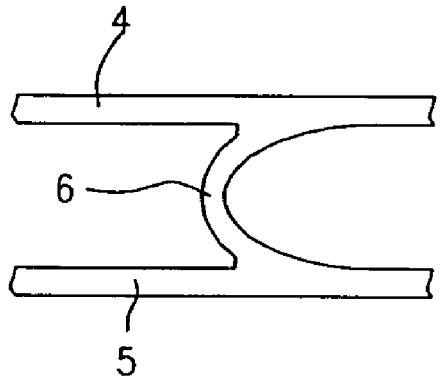
Figure 13:
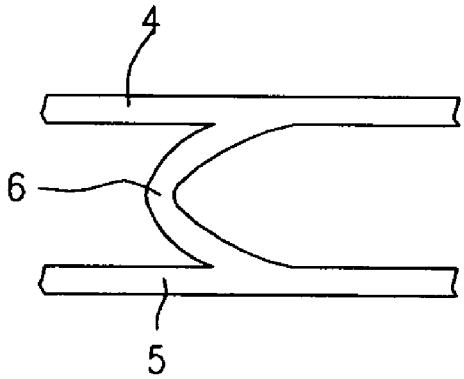

As shown in FIG. 6, the lateral strut members 9 disposed between the top lateral plate 7 and the bottom lateral plate 8 are also C-shaped when the midsole element is in an up-side-down position. The C-shaped strut members may have many variations. FIGS. 7-13 illustrate several examples.

The thickness of the strut members is about 0.5 mm to about 15 mm, preferably about 1 mm to about 6 mm, and more preferably about 2 mm to about 5 mm. The wall thickness of the strut members may be uniform or may be different for the medial and lateral elements to control pronation on the medial side and cushioning on the lateral side. Furthermore, for each strut member, the wall thickness may differ transversely or vertically to adjust cushioning depending on the application and individual the shoe is designed for. For example, it is contemplated that the wall thickness may taper from the lateral edge to the medial edge of a strut member. The configuration of the strut members may be modified by persons skilled in the art to optimize the performance of the midsole element and to customize for the specific application and individual wearing the shoe.

The material for the medial and lateral elements may be a plastic material, such as an engineered resin, or any durable elastomeric material. The top plates, strut members and bottom plates of the medial and lateral elements may be independently selected from the following exemplary materials bearing in mind that other suitable materials are also contemplated: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide available under the trademark Pebax®, engineered polyester available under the trademark Hytrel®, TPU blends including natural and synthetic rubbers, and blends or combinations thereof. TPU is the preferred material for the medial and lateral elements. In an exemplary embodiment of the present invention, the top plates, strut members and bottom plates of the medial and lateral elements are integrally molded from TPU. The hardness of the plastic material suitable for the midsole element is about 60 Shore A to about 70 Shore D, preferably about 75 Shore A to about 45 Shore D. The performance properties of the midsole can be adjusted by changing the hardness of the midsole element. For example, it is contemplated using a more compliant material for the lateral side of the element and another stiffer material for the medial side.

In addition to the midsole element, a midsole in accordance with the present invention may further comprise an arch support at the arch region of the midsole. It is contemplated that the arch support may be integrally molded with the medial element and/or the lateral element, for example at the top plates and/or bottom plates, or the arch support may be a separate element from the medial and lateral elements. In the exemplary embodiment shown in FIG. 1, the arch support 14 is integrally molded with the medial element 2 and the lateral element 3. The arch support is made of a flexible material for example a plastic material. The arch support may be selected from the following exemplary materials bearing in mind that other suitable materials are also contemplated: thermoplastic polyurethane (TPU), polyester-TPU, polyether-TPU, polyester-polyether TPU, polyvinylchloride, polyester, thermoplastic ethyl vinyl acetate, styrene butadiene styrene, polyether block amide available under the trademark Pebax®, engineered polyester available under the trademark Hytrel®, TPU blends including natural and synthetic rubbers, and blends or combinations thereof. TPU is the preferred material for the medial and lateral elements.

In view of the advantages of the C-shaped strut members discussed above, a midsole in accordance with another aspect of the present invention comprises a midsole element comprising a top plate; a bottom plate; and a plurality of strut members disposed between the top and bottom plates for supporting the top plate a distance away from the bottom plate; at least two, preferably most, and most preferably all, of the strut members being adjacent to each other and having a C shaped cross-section facing in the same direction when intersected by an imaginary plane that intersects the top and bottom plates at approximate right angles. The midsole element may comprise multiple elements, for example, a medial element and a lateral element. Alternatively, the midsole element may be a single element. For example, the midsole element may comprise a medial element only without the lateral element, or comprises a lateral element only without the medial element. The midsole element may be received in any portion of the shoe to provide desired cushioning and support for a selected region or all regions of the foot. For example, the midsole element may be located in the forefoot region, the heel region or the entire sole region.

The midsole element may further comprise a heel cleft. The heel cleft, in walking and running, is generally positioned so that it is medial to the point of impact. The purpose of the heel cleft is to make the heel of the shoe flexible. A flexible heel allows the heel of the shoe to bend at impact thus decreasing the moment arm (lever) in which the center of force is applied. As previously discussed, decreasing the moment arm decreases the amount and velocity of pronation. The point of impact may vary for a population of athletes and therefore it stretches along the lateral side of the heel. For example, Athlete A may impact the far edge of the lateral heel closest to the end of the heel and Athlete B may impact on the lateral edge of the heel closest to the midfoot. It is desirable to ensure that the heel cleft is positioned medial to each impact point for the entire population of athletes. This ensures that the heel cleft flexes on impact for the entire population of athletes.

Figure 14A:
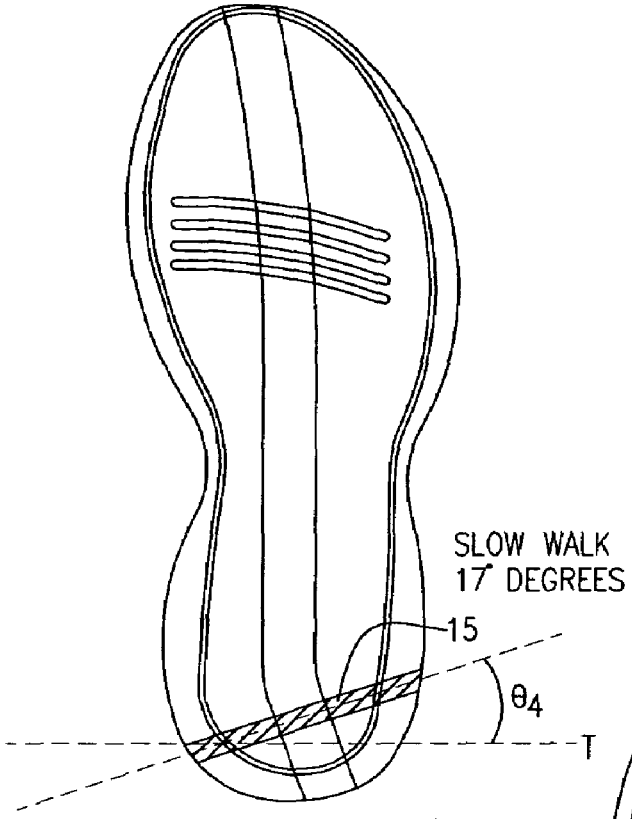
FIGS. 14A-D illustrate the effect of speed on the functional design of a heel cleft.
Figure 14B:
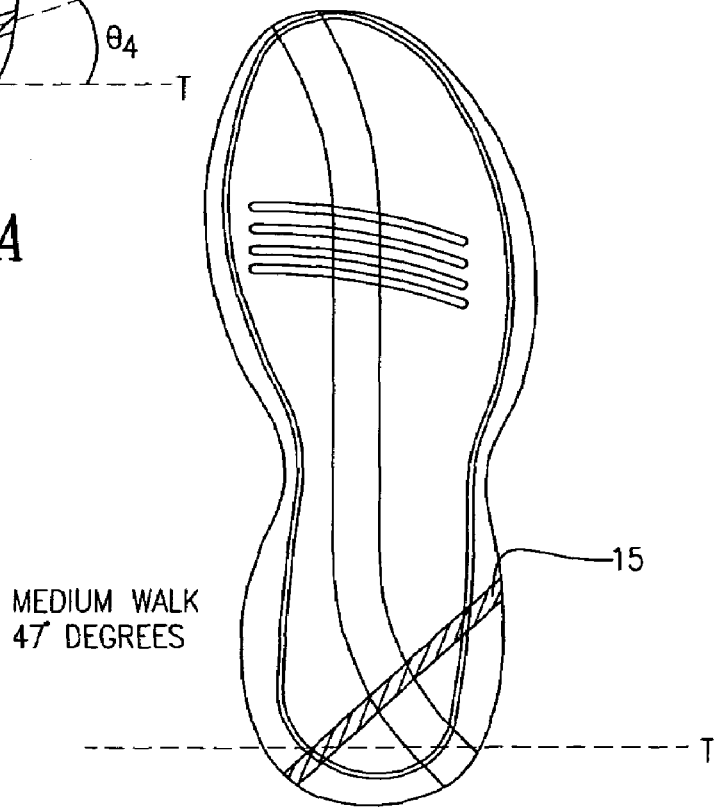
Figure 14C:
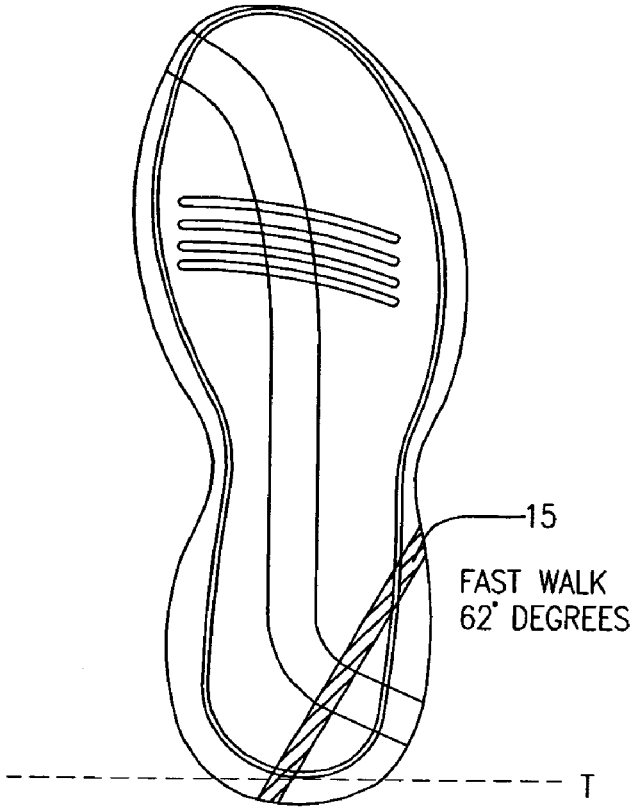
Figure 14D:
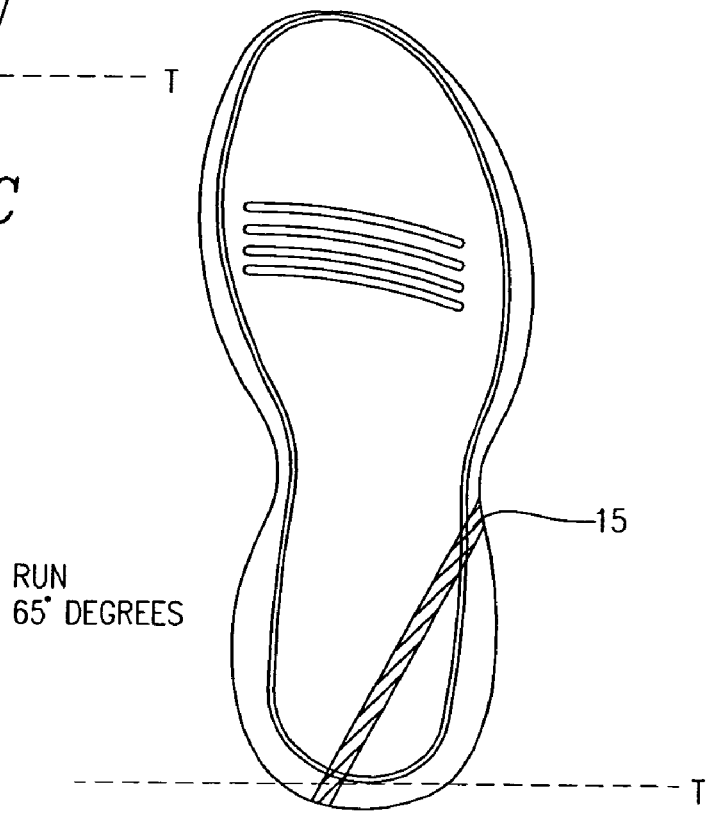

FIGS. 14A-D illustrate the effect of speed on the functional design of the heel cleft in the shoe sole. The heel cleft is oriented at an angle ($\theta_4$) offset from a transverse axis T of the sole or shoe. The heel cleft 15 is preferably disposed at an angle $\theta_4$ of about 17 degrees offset from the transverse axis T for the shoe that is typically used for slow walking as shown in FIG. 14A, about 47 degrees for medium walking as shown in FIG. 14B, about 62 degrees for fast walking as shown in FIG. 14C, and about 65 degrees for running as shown in FIG. 14D. It is also contemplated that a trail shoe may have a heel cleft oriented horizontally across the heel, i.e. at 0 degrees, and some sport shoes designed for lateral motion activities such as basketball, tennis and cross training may have a heel cleft at 90 degrees, generally centered in the heel. For example, the midsole element for a basketball shoe shown in FIG. 3 has a heel cleft 25 centered in the heel. Therefore, the heel cleft may be oriented about 0 to about 180 degrees, preferably about 0 to about 120 degrees, more preferably about 0 to about 90 degrees, most preferably about 10 to about 80 degrees, offset from the transverse axis of the midsole. For shoes intended for linear movement activities such as walking and running, the heel cleft is preferably about 15 to about 75 degrees, and more preferably about 17 and about 65 degrees, offset from the transverse axis of the midsole. For shoes intended for lateral movement activities such as basketball, the heel cleft may be about 65 to about 90 degrees, preferably about 75 to about 90 degrees, offset from the transverse axis of the midsole. Preferably, the strut members that are disposed laterally to the heel cleft are substantially perpendicular to the heel cleft to maximize shock absorption. For example, in a midsole element comprising a medial element and a lateral element, the lateral strut members of the lateral element may be oriented substantially perpendicular to the heel cleft.

In the exemplary embodiment shown in FIGS. 1 and 2, the lateral edge 11 of the cavity 10 generally corresponds to a heel cleft. It is also contemplated that the heel cleft may be in the form of a slit, a groove, a cavity of an elongated shape or any other shape, a line of weakened construction, or a line of flexible juncture formed by a material of greater elasticity and flexibility. U.S. Pat. No. 5,625,964, which is incorporated herein by reference in its entirety, describes a line of flexion, which is an example of a heel cleft in accordance with the present invention.

Figure 15:
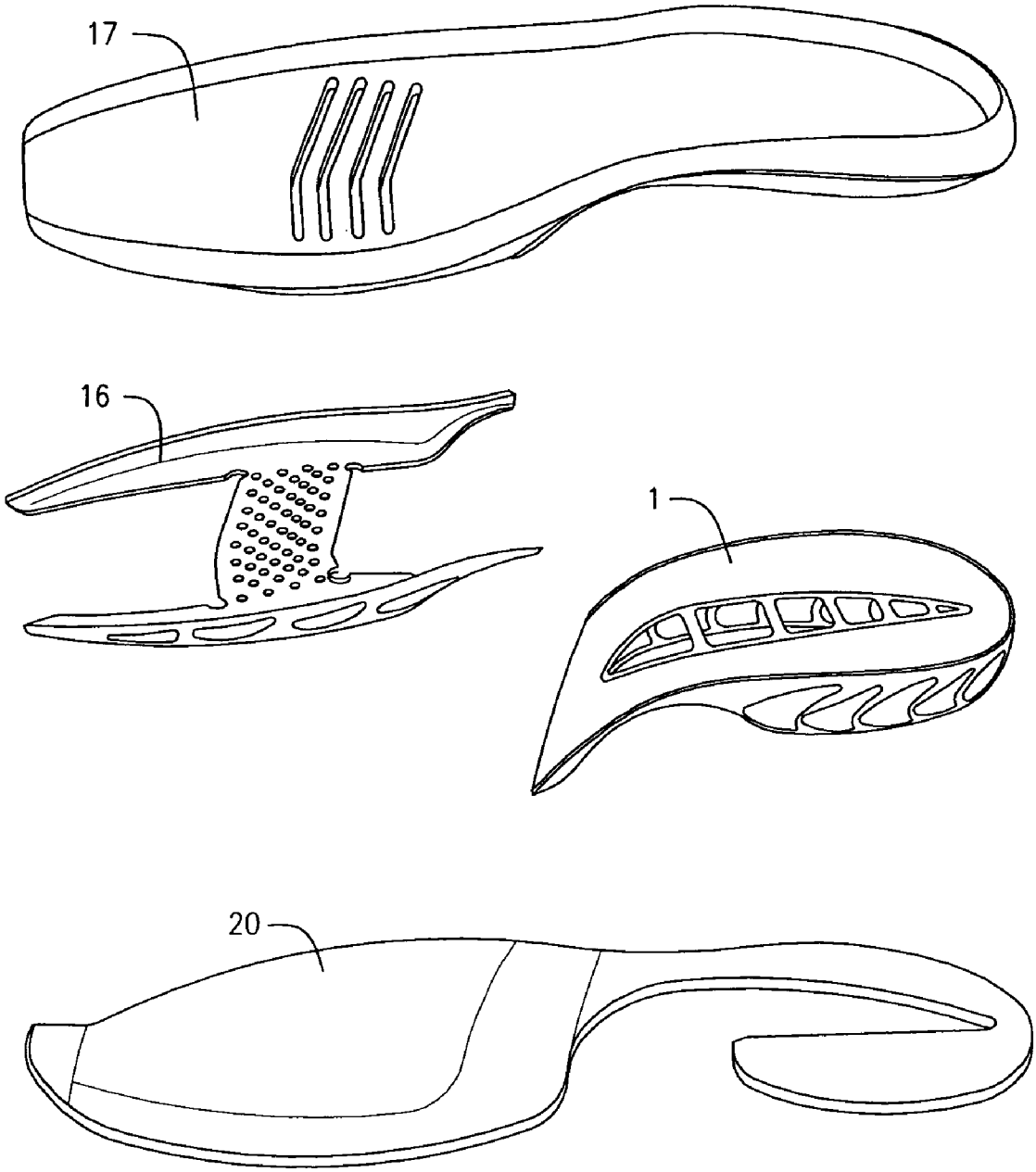
FIG. 15 is an exploded view of a sole in accordance with the present invention.

As shown in FIG. 15, a midsole may further comprise a flexible member 16 adapted to be received in the forefoot region of the shoe. The flexible member 16 is in contact with the midsole element 1 and is made of a flexible material such as a foam material, plastic material and engineered resin. In a preferred embodiment, the flexible member is composed of styrene butadiene styrene, which provides enhanced cushioning benefits and improved resistance to compression.

Although in the exemplary embodiments, the midsole elements are shown to be adapted to be received in the heel region of the shoe, it is contemplated that the midsole element of the present invention may be received in any portion of the shoe to provide desired cushioning and support for a selected region, for example the forefoot region, or all regions of the foot.

Figure 16:
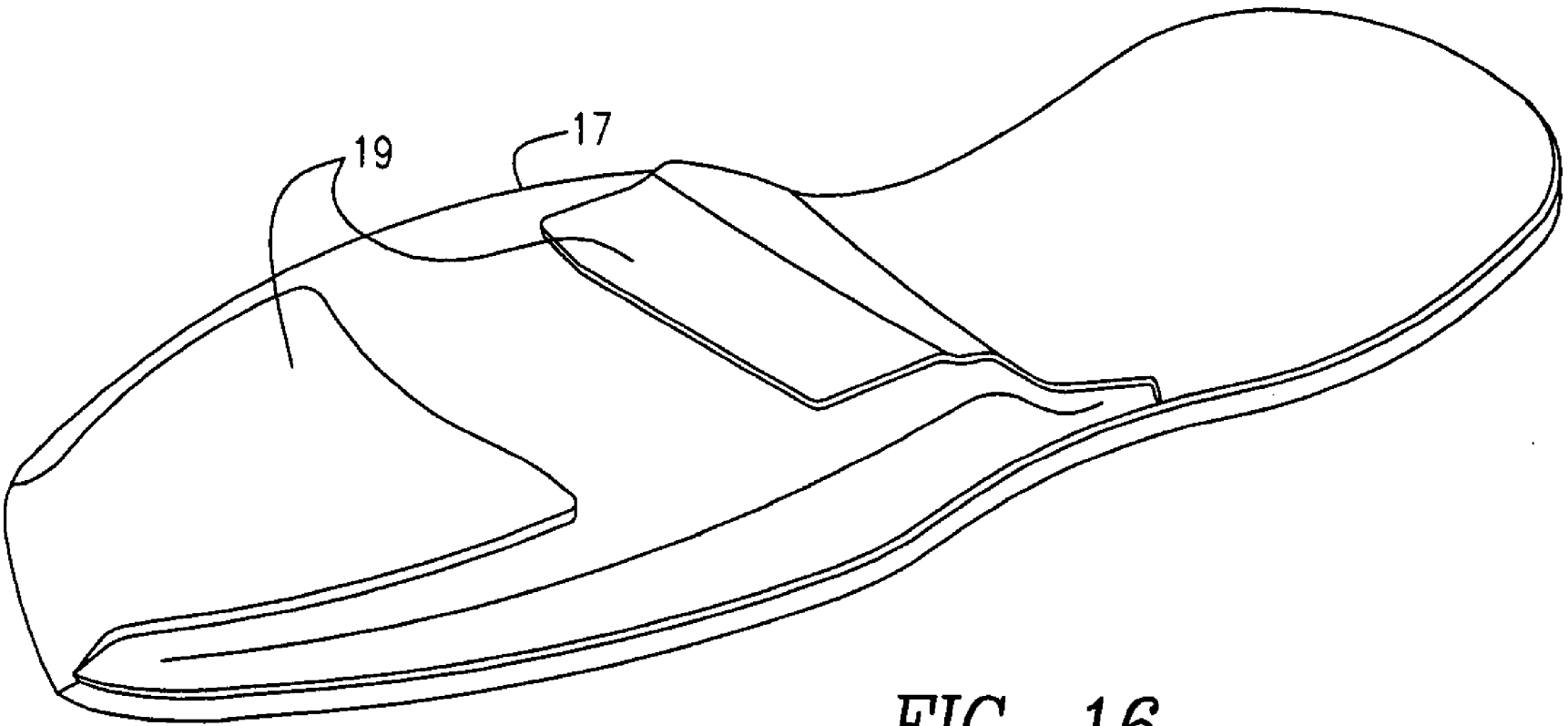
FIG. 16 is perspective view of a cushioning element.

The midsole in accordance with the present invention may further comprise a cushioning element 17 in contact with the top medial plate 4, the top lateral plate 7, and the flexible member 16. As illustrated in FIG. 16, the cushioning element 17 may have extruded portions 19 adapted to be received in the flexible member 16. Optionally, the cushioning element may have additional extruded portions adapted to be received in the cavity 10 between the bridging members 13 of the midsole element 1. The cushioning element 17 may serve as an insole for the shoe. Alternatively, the shoe may additionally have an insole.

The material for the cushioning element is preferably a foam material or any suitable elastic cushioning material. It may be selected from the following exemplary materials bearing in mind that other suitable materials are also contemplated: ethyl vinyl acetate (EVA) co-polymer, thermo-set polyether and poly-ester urethane, ethyl vinyl acetate co-polymer blends including isoprene rubber, poly-olefins, natural and synthetic rubbers, styrene butadiene styrene, and blends or combinations thereof. The EVA co-polymer is the preferred material for the cushioning element.

Figure 17:
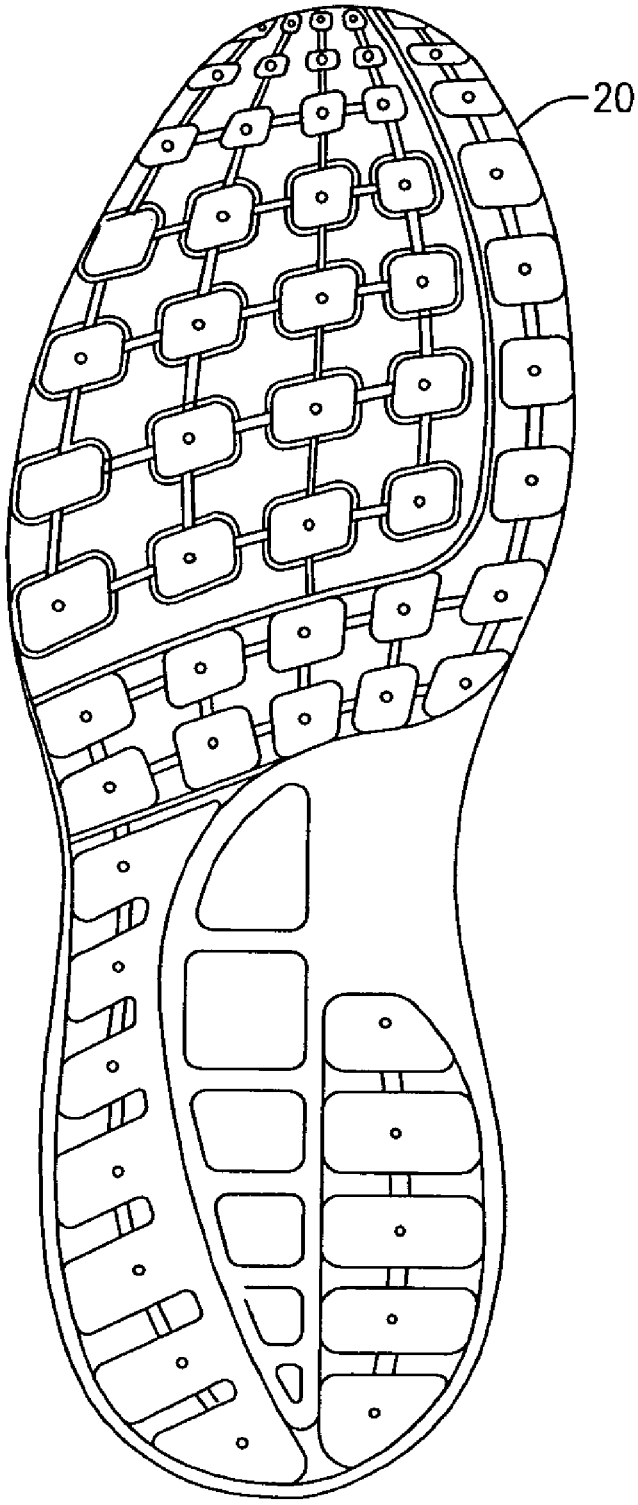
FIG. 17 is bottom plan view of a sole for a right shoe in accordance with the present invention.
Figure 18:
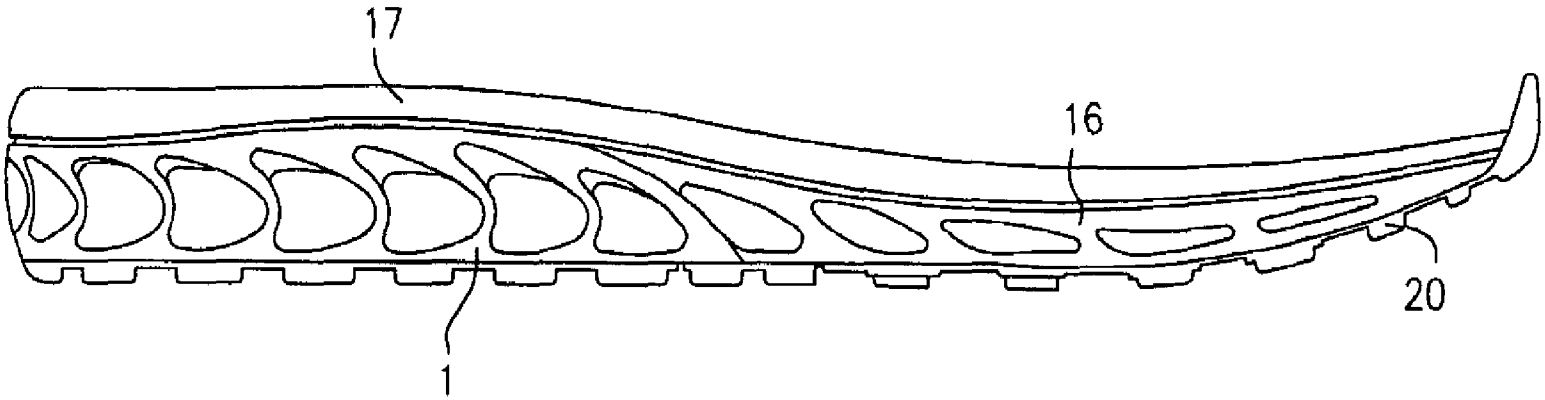
FIG. 18 is a lateral side view of the sole of FIG. 17.
Figure 19:
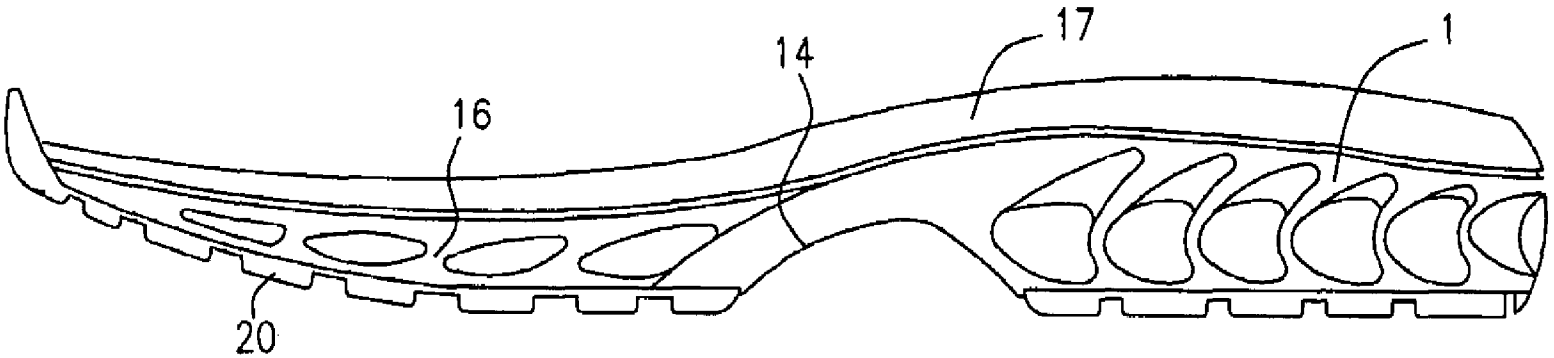
FIG. 19 is a medial side view of the sole of FIG. 17.

FIGS. 17-19 shows an assembled sole including a midsole element 1, a flexible member 16, a cushioning element 17, and an outsole 20. The flexible member 16 is in contact with the arch support 14 at the arch region. The cushioning element 17 is on top of the flexible member 16 and the midsole element 1.

Figure 20:
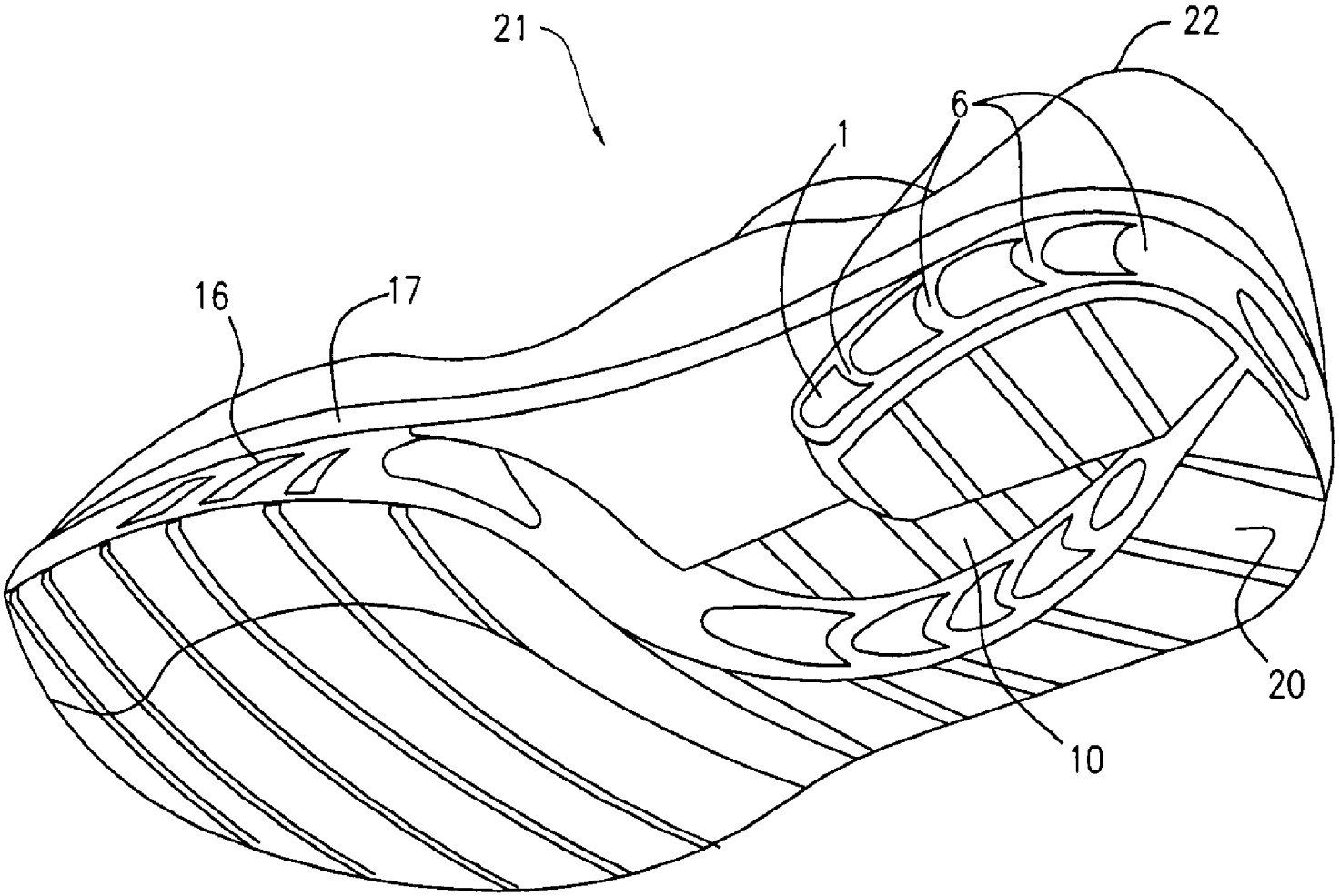
FIG. 20 is a perspective view of a shoe incorporating a midsole element in accordance with the present invention.
Figure 21:
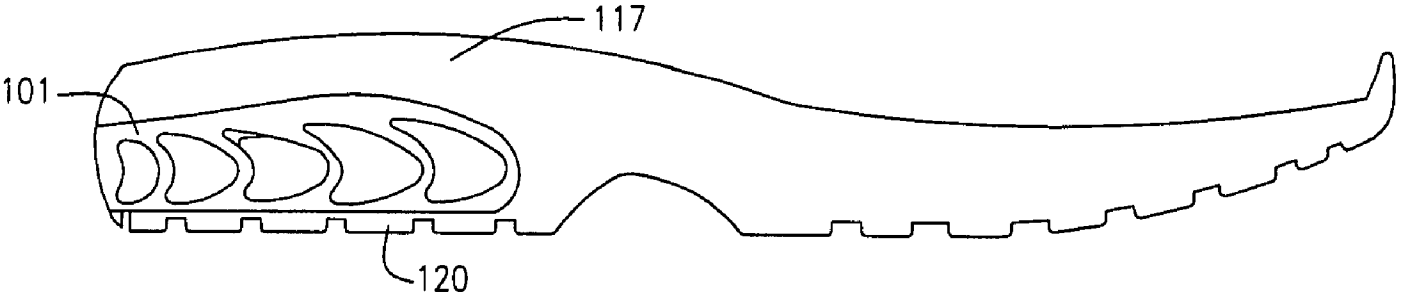
FIGS. 21-24 illustrate various alternative soles in accordance with the present invention.
Figure 22:
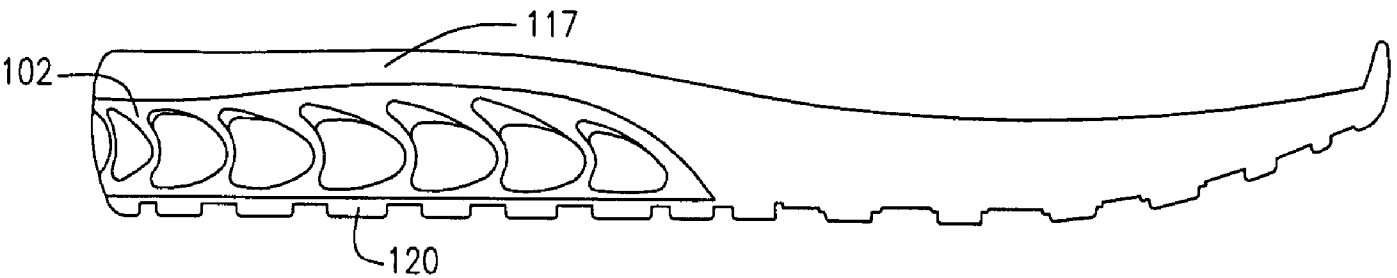
Figure 23:
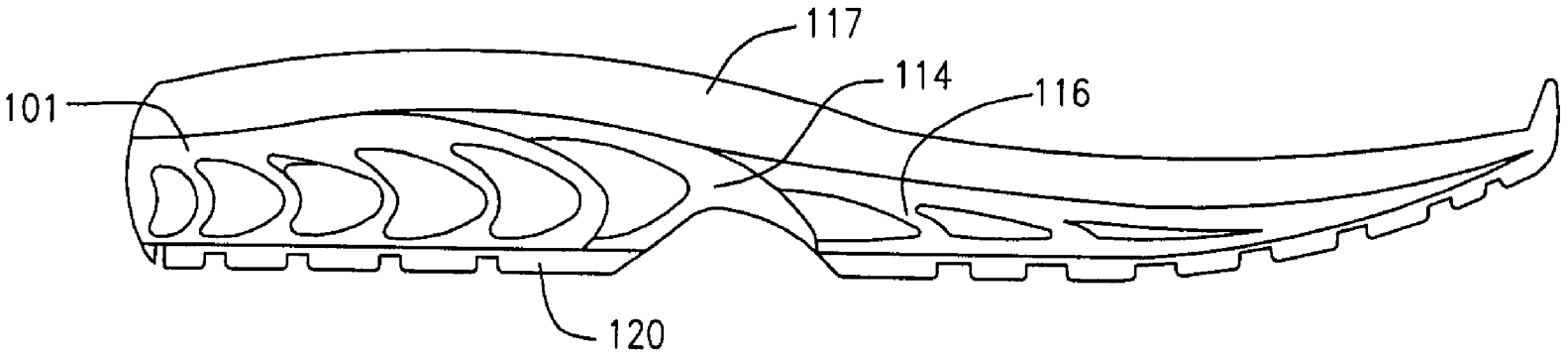
Figure 24:
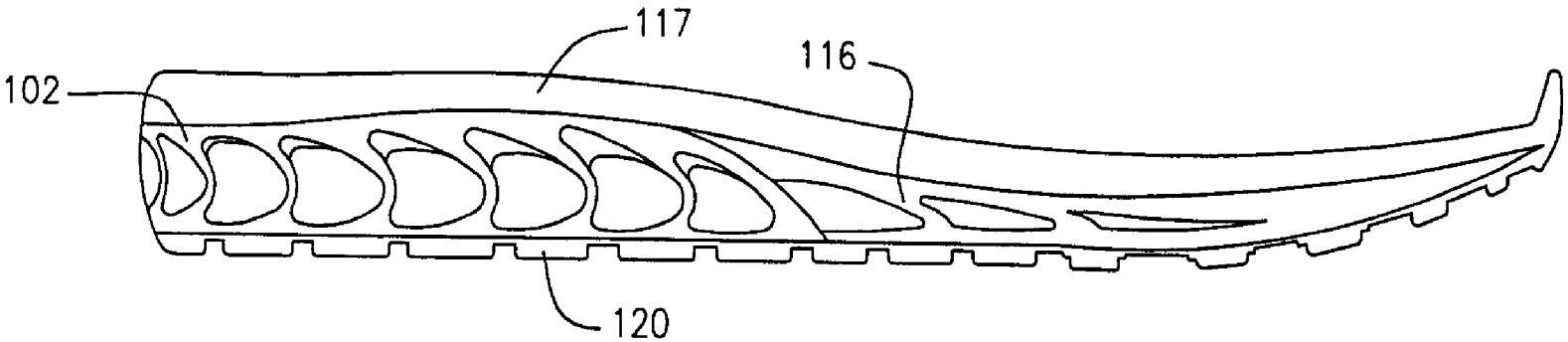
Figure 25:
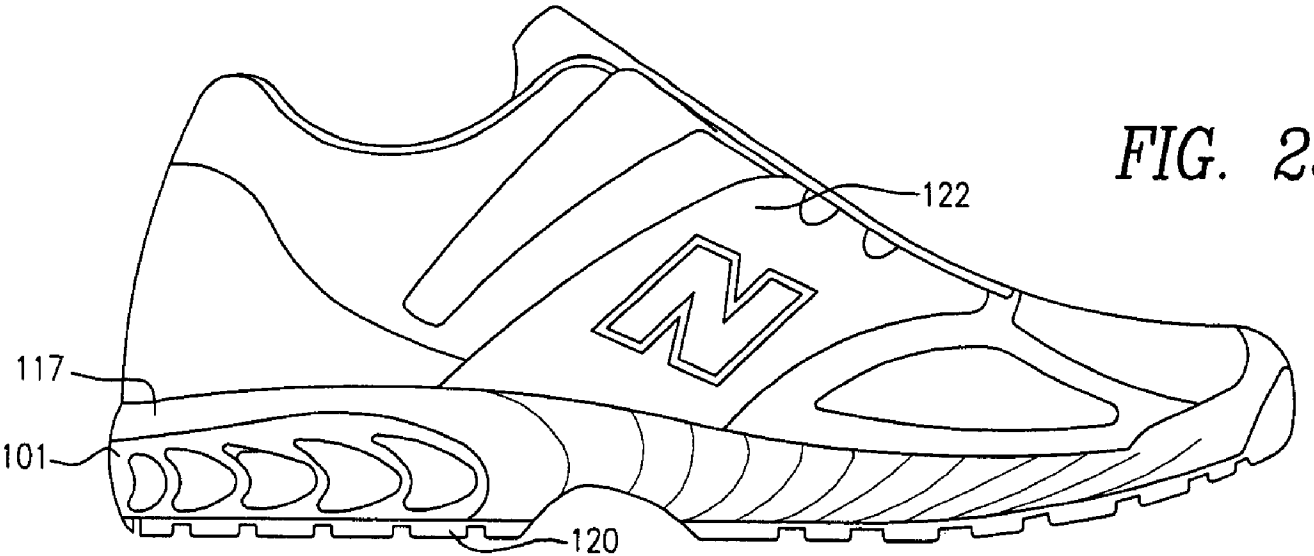
FIGS. 25-28 are side views of shoes incorporating the various alternative soles illustrated in FIGS. 21-24.
Figure 26:
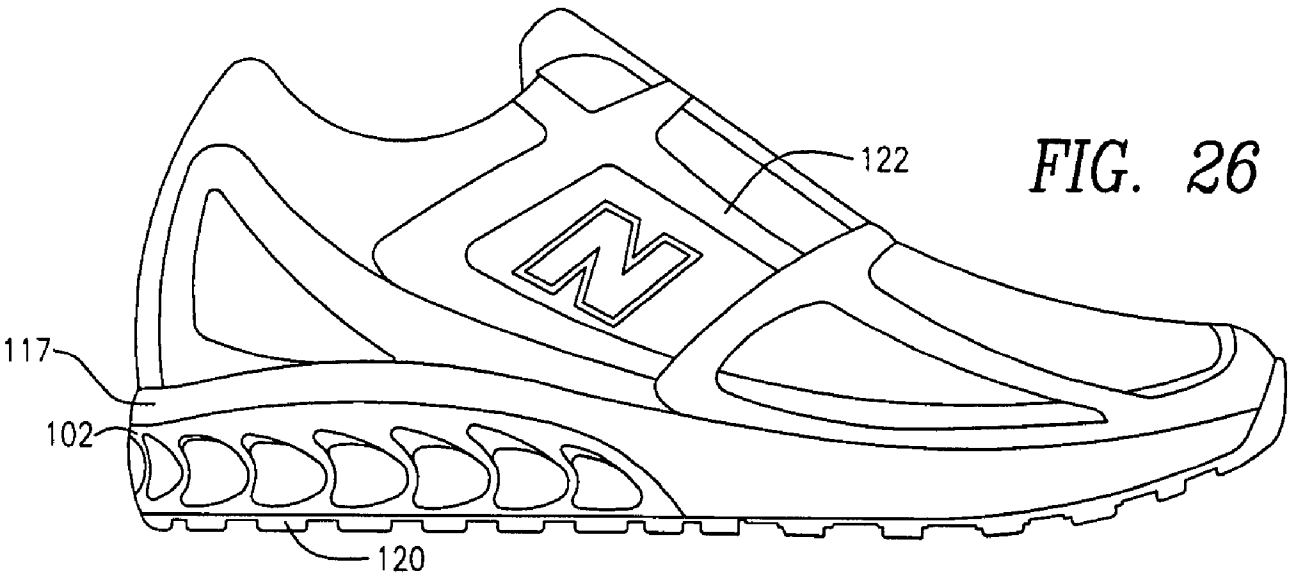
Figure 27:
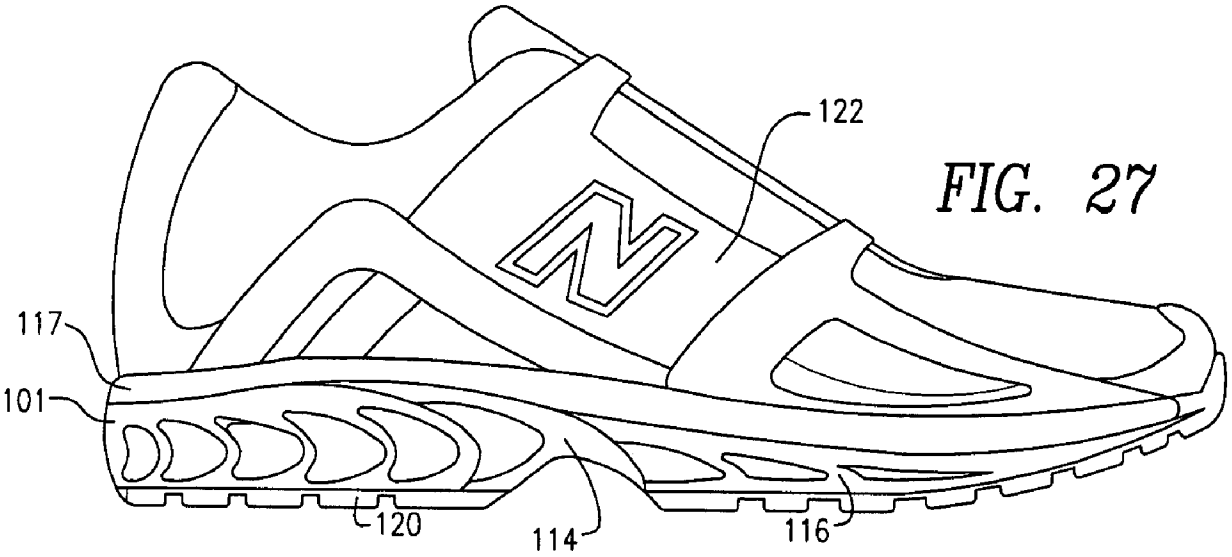
Figure 28:
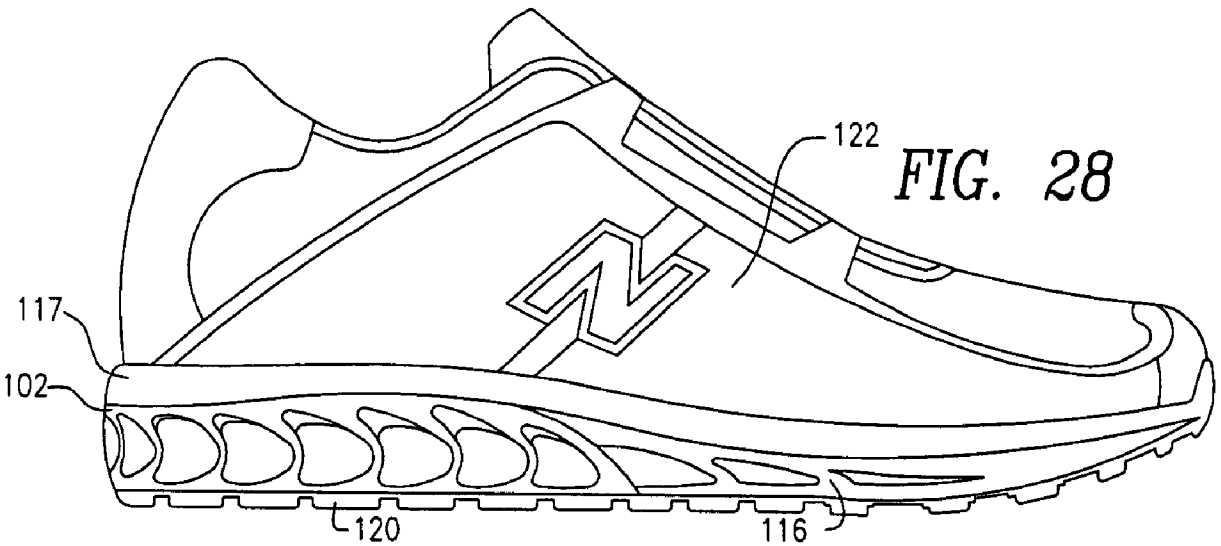

FIG. 20 shows a shoe incorporating a sole in accordance with the present invention. The shoe 21 has an upper 22, a midsole and an outsole 20. The midsole includes a midsole element 1, a flexible member 16 and a cushioning element 17. The C-shaped struts are preferably exposed peripherally for visual effect. The size and shape of the cavity 10 of the midsole element 1 may vary to balance the shock absorption and stability performance while minimizing the weight of the shoe.

FIGS. 21-24 illustrates several embodiments of soles in accordance with the present invention. The embodiment shown in FIG. 21 includes a midsole element 101, a cushioning element 117 and an outsole 120. This embodiment does not have an arch support or a flexible member. The embodiment shown in FIG. 22 includes a midsole element 102, which has more C-shaped strut members than the midsole element 101 shown in FIG. 21, a cushioning element 117 and an outsole 120. This embodiment does not have an arch support either. The embodiment shown in FIG. 23 includes a midsole element 101, an arch support 114, a cushioning element 117, a flexible member 116, and an outsole 120. The embodiment shown in FIG. 24 includes a midsole element 102, a cushioning element 117, a flexible member 116, and an outsole 120. This embodiment does not have an arch support. Further embodiments with various combinations of elements are also contemplated as falling within the scope of the present invention.

FIGS. 25-28 illustrate the shoes incorporating the soles shown in FIGS. 21-24 respectively. The shoes each further comprise an upper 122. Shoes at various price points can be developed by varying the number of strut members in the midsole element in combination with including or eliminating the arch support or the flexible member.

Figure 29:
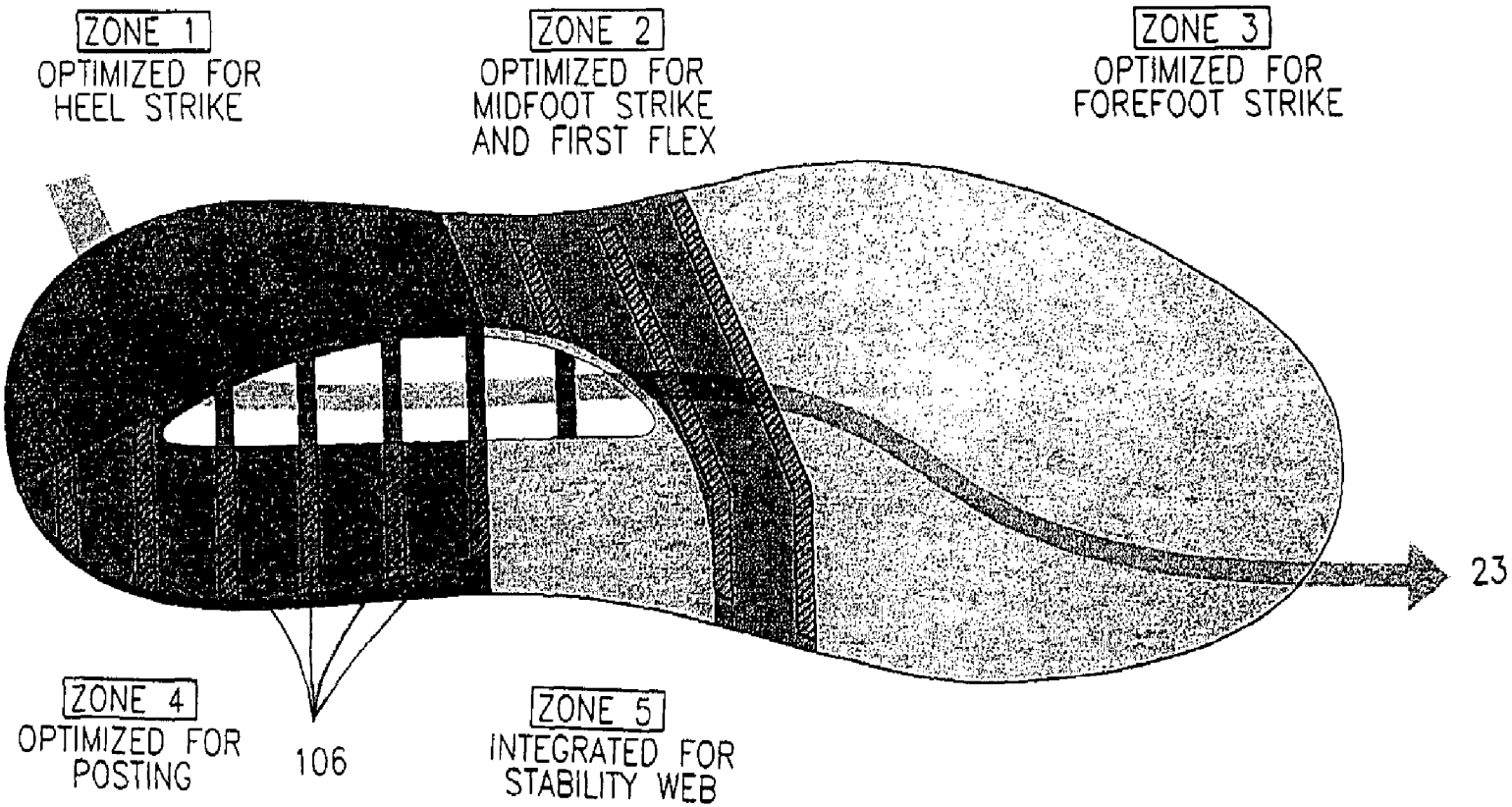
FIG. 29 illustrates 5 zones of a shoe in accordance with the present invention.

FIG. 29 illustrates 5 zones in a sole in accordance with the present invention throughout a running gait. Line 23 illustrates an approximate strike path of the running gait. It shows the progression of forces in a normal gait line as the foot goes from impact to propulsion. The normal gait line is the average vector of all forces that act on the bottom of a normal foot as it goes through the stance phase of a gait cycle. The shoe sole in accordance with the present invention has been tuned in 5 zones throughout the running gait. Zone 1 is optimized for heel strike. Zone 2 is optimized for midfoot strike and first-flex. Zone 3 is optimized for forefoot strike. Zone 4 is optimized for posting. Zone 5 incorporating an integrated arch support is optimized for stability. The strut members 106 at multiple zones provide mechanical cushioning properties anisotropically.

Figure 30:
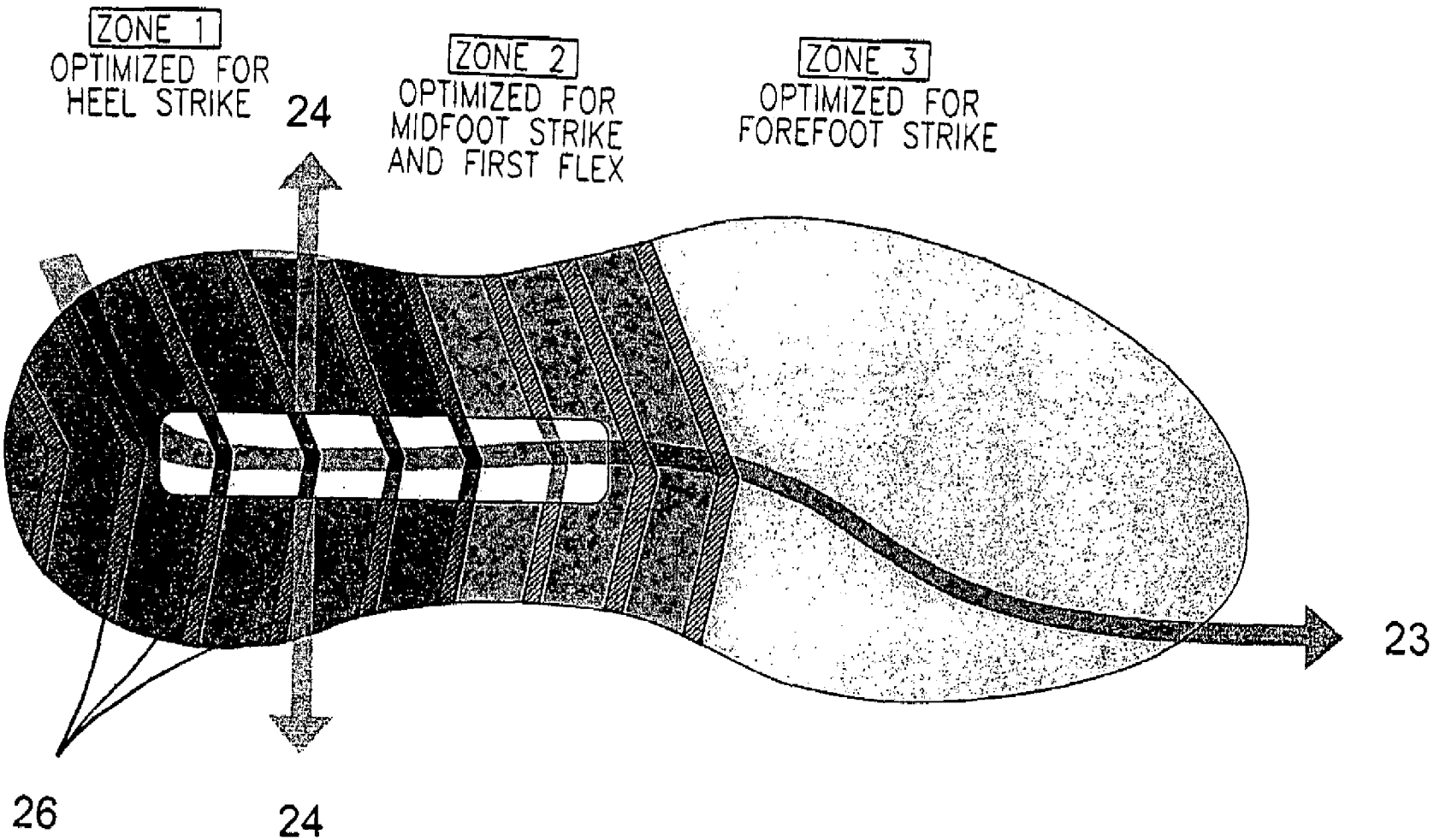
FIG. 30 illustrates 3 zones of an alternative embodiment in accordance with the present invention.

FIG. 30 illustrates 3 zones in a sole for a basketball shoe in accordance with the present invention throughout a running gait. Lines 24 illustrate medial and lateral movements. The shoe sole has been tuned in 3 zones throughout the running gait. Zone 1 is optimized for heel strike. Zone 2 is optimized for midfoot strike and first-flex. Zone 3 is optimized for forefoot strike.

While various embodiments and individual features of the present invention have been illustrated and described, it would be obvious to those skilled in the art that various other changes and modifications can be made without departing from the spirit and scope of the present invention. As will also be apparent to those skilled in the art, various combinations of the embodiments and features taught in the foregoing description are possible and can result in preferred executions of the present invention. Accordingly, it is intended that such changes and modifications fall within the scope of the present invention as defined by the claims appended hereto.

What is claimed is:

1. A midsole for an article of footwear, comprising:

(a) a medial element comprising:

a top medial plate;

a bottom medial plate; and a plurality of medial strut members disposed between said top and bottom medial plates for supporting said top medial plate a distance away from said bottom medial plate, wherein at least two adjacent medial strut members are oriented at a first angle relative to a longitudinal axis of said article of footwear to define a medial stiffening axis, said at least two adjacent medial strut members oriented and adapted to preferentially deflect in the same direction transversely to said medial stiffening axis in response to a force imparted on said medial element of said article of footwear during use, one of said at least two adjacent medial strut members adapted to preferentially deflect in said same direction toward the other of said at least two adjacent medial strut members, thereby providing directional flexibility transverse to said medial stiffening axis; and (b) a lateral element comprising:

a top lateral plate;

a bottom lateral plate; and a plurality of lateral strut members disposed between said top and bottom lateral plates for supporting said top lateral plate a distance away from said bottom lateral plate, wherein at least two adjacent lateral strut members are oriented at a second angle relative to the longitudinal axis of said article of footwear to define a lateral stiffening axis, said at least two adjacent lateral strut members oriented and adapted to preferentially deflect in the same direction transversely to said lateral stiffening axis in response to a force imparted on said lateral element of said article of footwear during use, one of said at least two adjacent lateral strut members adapted to preferentially deflect in said same direction toward the other of said at least two adjacent lateral strut members, thereby providing directional flexibility transverse to said lateral stiffening axis;

wherein said lateral stiffening axis is arranged at an angle to said medial stiffening axis, said at least two adjacent lateral strut members and said at least two adjacent medial strut members adapted and arranged to provide flexibility and stifihess anisotropically to said midsole.

2. The midsole of claim 1, wherein said angle is greater than 0 degrees to less than 180 degrees.

3. The midsole of claim 1, wherein said angle is about 5 degrees to about 120 degrees.

4. The midsole of claim 1. wherein said angle is about 10 degrees to about 90 degrees.

5. The midsole of claim 1, wherein said angle is about 15 degrees to about 75 degrees.

6. The midsole of claim 1, wherein said plurality of medial strut members are substantially perpendicular to the longitudinal axis of the midsole.

7. The midsole of claim 1, wherein said second angle at which said at least two adjacent lateral strut members are oriented is greater than 0 degrees to about 90 degrees offset from the longitudinal axis of the midsole.

8. The midsole of claim 1, wherein said second angle at which said at least two adjacent lateral strut members are oriented is about 10 degrees to about 90 degrees offset from the longitudinal axis of the midsole.

9. The midsole of claim 1, wherein said second angle at which said at least two adjacent lateral strut members are oriented is about 15 to about 75 degrees offset from the longitudinal axis of the midsole.

10. The midsole of claim 1, wherein said second angle at which said at least two adjacent lateral emit members are oriented is about 17 to about 65 degrees offset from the longitudinal axis of the midsole.

11. The midsole of claim 1, wherein said first angle at which said at least two adjacent medial strut members are oriented is greater than 0 degree to about 90 degrees offset from the longitudinal axis of the midsole.

12. The midsole of claim 1, wherein said first angle at which said at least two adjacent medial strut members are oriented is about 10 to about 90 degrees offset from the longitudinal axis of the midsole.

13. The midsole of claim 1, wherein said first angle at which said at least two adjacent medial strut members are oriented is about 15 to about 75 degrees offset from the longitudinal axis of the midsole.

14. The midsole of claim 1, wherein said medial and lateral strut members have a C shaped cross-section when intersected by an imaginary plane that intersects the respective top and bottom medial and lateral plates at approximate right angles.

15. The midsole of claim 14, wherein at least two adjacent C shaped strut members face in the same direction.

16. The midsole of claim 1, wherein said midsole further comprises a cavity between said medial element and said lateral element.

17. The midsole of claim 16, wherein said cavity has a lateral edge and a medial edge, and said lateral strut members are arranged substantially perpendicular to said lateral edge of said cavity.

18. The midsole of claim 1, wherein said medial element and said lateral element are connected at their rear ends.

19. The midsole of claim 18, wherein said medial element and said lateral element are integrally molded.

20. The midsole of claim 1, said medial element and said lateral element are connected by at least one bridging member between the top medial plate and the top lateral plate.

21. The midsole of claim 1, wherein said midsole further comprises a heel cleft which is media to the point of heel strike at said midsole, said heel cleft providing flexibility to said midsole and allowing said midsole to bend at impact thereby decreasing the amount and velocity of pronation.

22. The midsole of claim 21, wherein said heel cleft is about 0 to about 120 degrees offset from a transverse axis of the midsole.

23. The midsole of claim 21, wherein said heel cleft is about 0 to about 90 degrees offset from a transverse axis of the midsole.

24. The sole of claim 21, wherein said heel cleft is about 10 and about 80 degrees offset from a transverse axis of the midsole.

25. The midsole of claim 1, wherein said medial and lateral top plates, medial and lateral shut members and medial and lateral bottom plates are independently selected from the following materials: thermoplastic polyurethane (TPU), polyester-TPU, polyether-TPU. polyester-polyether TPU, polyvinylchloride, polyester, thermoplastic ethyl vinyl acetate, styrene butadiene styrene, polyether block amide, engineered polyester, TPU blends including natural and synthetic rubbers, and blends or combinations thereof.

26. The midsole of claim 1, wherein said stint members are made of a plastic material having a hardness of about 60 Shore A to about 70 Shore D.

27. The midsole of claim 1, wherein said strut members are made of a plastic material having a hardness of about 75 Shore A to about 45 Shore D.

28. The midsole of claim 27, wherein said strut members have a thickness of about 1 mm to about 6 mm.

29. The midsole of claim 1, wherein said strut members are made of thermoplastic polyurethane (TPU).

30. The midsole of claim 1, wherein said strut members have a thickness of about 0.5 mm to about 15 mm.

31. The midsole of claim 1, wherein said strut members have a thickness of about 1 mm to about 6 mm.

32. The midsole of claim 1, further comprising a cushioning element in contact with at least one of said medial and lateral elements.

33. The midsole of claim 32, wherein said cushioning clement is disposed on top of said top medial and lateral plates of said medial and lateral elements.

34. The midsole of claim 32, wherein said cushioning element is made of a foam material or styrene butadiene styrene.

35. The midsole of claim 1, further comprising an arch support at the arch region of the midsole, said arch support being integrally molded with said medial element and/or said lateral element, or said arch support being a separate element.

36. The midsole of claim 35, wherein said arch support is made of a plastic material.

37. The midsole of claim 1, further comprising a flexible member disposed in the forefoot region of the midsole.

38. The midsole of claim 37, wherein said flexible member is made of an engineered resin.

39. The midsole of claim 1, wherein said medial element and said lateral element are disposed in the heel region of said midsole.

40. The midsole of claim 1, wherein said plurality of medial strut members are substantially perpendicular to The longitudinal axis of the midsole, and said plurality of lateral strut members are oriented at an angle of about 15 degrees to 75 degrees offset from the longitudinal axis; wherein said plurality of medial and lateral strut members are made of a plastic material having a hardness of about 75 Shore A to about 45 Shore D; wherein said plurality of medial and lateral strut members have a C shaped cross-section when intersected by an imaginary plane that intersects the respective top and bottom medial and lateral plates at approximate right angles, adjacent C shaped strut members facing The same direction; and wherein said plurality of medial and lateral strut members have a thickness of about 1 mm to about 6 mm.

41. An article of footwear, comprising an upper, the midsole of claim 40 and an outsole.

42. The midsole of claim 1, wherein said plurality of medial strut members are oriented at an angle of about 15 degrees to 75 degrees offset from the longitudinal axis of the midsole, and said plurality of lateral strut members are oriented at an angle of about 15 degrees to 75 degrees offset from the longitudinal axis; wherein said plurality of medial and lateral strut members are made of a plastic material having a hardness of about 75 Shore A to about 45 Shore D; wherein said plurality of medial and lateral strut members have a C shaped cross-section when intersected by an imaginary plane that intersects the respective top and bottom medial and lateral plates at approximate right angles, adjacent C shaped strut members facing the same direction; and wherein said plurality of medial and lateral strut members have a thickness of about 1 mm to about 6 mm.

43. An article of footwear, comprising an upper, the midsole of claim 1 and an outsole.

44. A midsole for an article of footwear, comprising:

(a) a medial element comprising:

a top medial portion;

a bottom medial portion; and a plurality of medial strut members disposed between said top and bottom medial portions for supporting said top medial portion a distance away from said bottom medial portion;

wherein at least two adjacent medial strut members are oriented at a first angle relative to a longitudinal axis of said article of footwear to define a medial stiffening axis, said at least two adjacent medial strut members oriented and adapted to preferentially deflect in the same direction transversely to said medial stiffening axis in response to a force imparted on said medial element of said article of footwear during use, one of said at least two adjacent medial strut members adapted to preferentially deflect in said same direction toward the other of said at least two adjacent medial strut members, thereby providing directional flexibility transverse to said medial stiffening axis; and (b) a lateral element comprising:

a top lateral portion;

a bottom lateral portion and a plurality of lateral strut members disposed between said top and bottom lateral portions for supporting said top lateral portion a distance away from said bottom lateral portion;

wherein at least two adjacent lateral strut members are oriented at a second angle relative to the longitudinal axis of said article of footwear to define a lateral stiffening axis, said at least two adjacent lateral strut members oriented and adapted to preferentially deflect in the same direction transversely to said lateral stiffening axis in response to a force imparted on said lateral element of said article of footwear during use, one of said at least two adjacent lateral strut members adapted to preferentially deflect in said same direction toward the other of said at least two adjacent lateral strut members, thereby providing directional flexibility transverse to said lateral stiffening axis;

wherein said lateral stiffening axis is arranged at an angle to said medial stiffening axis, said at least two adjacent medial strut members and said at least two adjacent lateral strut members adapted and arranged to provide flexibility and stiffness anisotropically to said midsole.

45. The midsole of claim 44, wherein said medial and lateral element of said midsole are integrally molded with said midsole.

46. The midsole of claim 1, wherein said midsole is integrally molded.

47. A midsole element for an article of footwear, comprising:

(a) a medial element comprising:

a top medial plate;

a bottom medial plate; and a plurality of medial strut members disposed between said top and bottom medial plates for supporting said top medial plate a distance away from said bottom medial plate; and (b) a lateral element comprising;

a top lateral plate;

a bottom lateral plate; and a plurality of lateral strut members disposed between said top and bottom lateral plates for supporting said top lateral plate a distance away from said bottom lateral plate;

wherein said medial element is separated from said lateral element by a cavity; and (c) at least one bridging element extending across a central portion of said cavity to connect said medial element to said lateral element, wherein said at least one bridging member is integrally connected to the top medial plate of said medial element and to the top lateral plate of said lateral element, said at least one bridging member having a thickness less than that of said medial or lateral element.

48. An article of footwear, comprising an upper, an outsole, the midsole of claim 47, and a cushioning element in contact with said top medial plate and said top lateral plate.

* * * * *